US007942345B2

(12) United States Patent
Sesser et al.

(10) Patent No.: US 7,942,345 B2
(45) **Date of Patent: *May 17, 2011**

(54) SPRINKLER WITH NUTATING MECHANISM AND OPTIONAL WEIGHT

(75) Inventors: George L. Sesser, Walla Walla, WA (US); Craig B. Nelson, Walla Walla, WA (US); Reid A. Nelson, Walla Walla, WA (US); Lee A. Perkins, Lowden, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 180 days.

This patent is subject to a terminal disclaimer.

(21) Appl. No.: 12/222,740

(22) Filed: Aug. 14, 2008

(65) Prior Publication Data

US 2010/0038450 A1 Feb. 18, 2010

(51) Int. Cl.
*B05B 3/04* (2006.01)

(52) U.S. Cl. ..... 239/222.21; 239/222.11; 239/231; 239/524

(58) Field of Classification Search ..... 239/222.11, 239/222.17, 222.21, 231, 518, 524
See application file for complete search history.

(56) References Cited

U.S. PATENT DOCUMENTS

| | | | | |
|---|---|---|---|---|
| 2,848,276 | A | 8/1958 | Clearman | |
| 3,034,728 | A | 5/1962 | Hruby, Jr. | |
| 3,532,273 | A | 10/1970 | Siddal et al. | |
| 3,958,643 | A | 5/1976 | Landsberg | |
| 3,964,685 | A | 6/1976 | Chauvigne | |
| 4,073,438 | A | 2/1978 | Meyer | |
| 4,487,368 | A | 12/1984 | Clearman | |
| 5,381,960 | A | 1/1995 | Sullivan et al. | |
| 5,439,174 | A | 8/1995 | Sweet | |
| 5,588,595 | A | 12/1996 | Sweet et al. | |
| 5,671,885 | A | 9/1997 | Davisson | |
| 5,950,927 | A | 9/1999 | Elliott et al. | |
| 6,092,739 | A * | 7/2000 | Clearman et al. | 239/237 |
| 6,176,440 | B1 | 1/2001 | Elliott | |
| 6,267,299 | B1 | 7/2001 | Meyer | |
| 6,360,965 | B1 * | 3/2002 | Clearman et al. | 239/222.11 |
| 6,382,525 | B1 | 5/2002 | Santiesteban et al. | |
| 6,439,477 | B1 | 8/2002 | Sweet et al. | |
| 6,530,532 | B1 | 3/2003 | Santiesteban et al. | |
| 6,932,279 | B2 | 8/2005 | Burcham | |
| 7,070,122 | B2 | 7/2006 | Burcham et al. | |
| 7,287,710 | B1 | 10/2007 | Nelson et al. | |
| 7,395,977 | B2 | 7/2008 | Pinch et al. | |

OTHER PUBLICATIONS

U.S. Appl. No. 12/416,558, filed Apr. 1, 2009 (Pending).

* cited by examiner

*Primary Examiner* — Steven J Ganey
(74) *Attorney, Agent, or Firm* — Nixon & Vanderhye, P.C.

(57) ABSTRACT

A rotary, nutating sprinkler head includes a housing supporting a nozzle tube extending in a downstream direction, concentric with a vertical center axis of the sprinkler head; a spool assembly loosely supported on the starter tube, the spool assembly including a double-flanged spool and a water-deflection plate carried by the spool, the water-deflection plate formed with one or more grooves shaped to cause the spool assembly to rotate when impinged upon by a stream emitted from the starter tube; wherein one of the starter tube and the spool is provided with at least one tilting lug located to maintain the spool assembly in a tilted or angularly offset orientation relative to the vertical center axis, thereby facilitating a wobbling action of the spool assembly during rotation.

24 Claims, 25 Drawing Sheets

SPRINKLER WITH NUTATING MECHANISM AND OPTIONAL WEIGHT

BACKGROUND OF THE INVENTION

This invention relates to rotary sprinkler heads and, more particularly, to sprinkler heads that nutate (i.e., wobble while they rotate) to minimize the "donut effect" prevalent with conventional rotary sprinkler heads.

Conventional rotary sprinklers typically throw one or more streams in a radial direction to wet a specified area in a circular pattern. In circumstances where the sprinkler is in a fixed location, unless some mechanism is employed to break up the one or more streams, a donut pattern is created that leaves a substantial dry area inside the pattern. A higher speed of rotation tends to break down the stream or streams, but also shortens the throw radius. An alternative is the wobbling-type sprinkler where a water-deflection plate is caused to wobble as it rotates (sometimes referred to as a nutating action). Various nutating or wobbling sprinkler head designs have been available but with potential shortcomings that can nullify the very effect that makes such sprinklers attractive in the first instance. Examples of known nutating or wobbling sprinkler heads may be found in U.S. Pat. Nos. 5,381,960; 5,950,927; and 6,932,279. Commonly owned U.S. Pat. Nos. 5,439,174; 5,588,595; 5,671,885; 6,267,299; and 6,439,477 provide further examples.

A problem often encountered with sprinklers of this type relates to stalling, primarily at start-up, but possibly also during normal operation. Stalling occurs when the water-deflection plate of the sprinkler head fails to tilt at start-up, or ceases tilting during operation, thereby simply rotating (without wobbling) and distributing a stream particularly susceptible to the donut effect. When nutating or wobbling sprinklers operate as designed, the wobbling action tends to fill in the pattern in a substantially uniform manner. Thus, it is critical that the water-deflection plate reliably and consistently remain in a tilted orientation on start-up and while rotating to achieve the desired wobbling action.

BRIEF SUMMARY OF THE INVENTION

In one exemplary but nonlimiting embodiment, a sprinkler head includes a housing supporting a nozzle and a spool assembly. The spool assembly is made up of a double-flanged spool and a water-distribution plate carried by the spool, downstream of the nozzle. The spool assembly is loosely supported on a starter tube coaxially aligned with, and also extending downstream of the nozzle. Mechanical elements such as lugs are located on either the starter tube or a lower flange of the spool for maintaining the spool assembly in a tilted or offset orientation relative to a longitudinal center axis through the sprinkler head. An annular race is supported within the housing and is adapted to be engaged by surfaces of upper and lower flanges of the spool during rotation of the spool assembly.

An optional weight can be attached to the sprinkler head housing for stability, utilizing cooperable surface features enabling quick attachment and detachment of the weight.

Thus, in accordance with one nonlimiting aspect of the invention, there is provided a rotary, nutating sprinkler head comprising a housing supporting a nozzle tube extending in a downstream direction, concentric with a vertical center axis of the sprinkler head; a spool assembly loosely supported on the starter tube, the spool assembly including a double-flanged spool and a water-deflection plate carried by the spool, the water-deflection plate formed with one or more grooves shaped to cause the spool assembly to rotate when impinged upon by a stream emitted from the starter tube; wherein one of the starter tube and the spool is provided with at least one tilting lug located to maintain the spool assembly in a tilted or angularly offset orientation relative to the vertical center axis, thereby facilitating a wobbling action of the spool assembly during rotation.

In another nonlimiting aspect, the invention relates to a rotary, nutating sprinkler head comprising: a housing supporting a nozzle tube extending in a downstream direction, concentric with a vertical center axis of the sprinkler head; a spool assembly loosely supported on the nozzle tube, the spool assembly including a double-flanged spool and a water-deflection plate carried by the spool, the water-deflection plate formed with one or more grooves shaped to cause the spool assembly to rotate when impinged upon by a stream emitted from the nozzle tube; and an annular race supported in the housing having upper and lower surfaces engageable by portions of the upper and lower flanges, respectively, of the spool as the spool assembly rotates and wobbles about the center axis.

In still another aspect, the invention relates to a rotary, nutating sprinkler head comprising: a housing supporting a nozzle tube extending in a downstream direction, concentric with a vertical center axis of the sprinkler head; a spool assembly loosely supported on the nozzle tube, the spool assembly including a spool having a hub and upper and lower flanges, a water-deflection plate carried by the spool, the water-deflection plate formed with one or more grooves shaped to cause the spool assembly to rotate when impinged upon by a stream emitted from the nozzle tube; an annular race supported in the housing having upper and lower surfaces engageable by portions of the upper and lower flanges, respectively, of the spool as the spool assembly rotates and wobbles about the center axis; and plural mating teeth formed on a radially inner surface of the race and on a lower portion of the hub for mated rolling action of the spool assembly about the race.

In still another nonlimiting aspect, the invention relates to rotary, nutating sprinkler head comprising a housing supporting a nozzle including a starter tube extending in a downstream direction, concentric with a vertical center axis of the sprinkler head; a cage assembly loosely supported on the starter tube, the cage assembly including a disc and a water-deflection plate supported by plural struts extending downwardly from the disc, the water-deflection plate formed with one or more grooves shaped to cause the cage assembly to rotate when impinged upon by a stream emitted from the starter tube; one or more tilting lugs located to maintain the cage assembly in a tilted or angularly offset orientation relative to the vertical center axis, thereby facilitating a wobbling action of the cage assembly during rotation; and a race supported in the housing and surrounding the cage assembly, the race adapted to be engaged in rolling contact by radial outward surfaces of the disc.

In still another nonlimiting aspect, the invention relates to a race for use in a wobbling sprinkler head comprising an annular ring having upper and lower surfaces and radially inner and outer edges, the upper and lower surfaces formed with oppositely facing annular grooves forming an annular narrow neck portion radially between the inner and outer edges; one of the oppositely facing grooves incorporating a plurality of circumferentially-spaced ribs therein.

The exemplary embodiments of the invention will now be described in detail in connection with the drawings identified below.

DETAILED DESCRIPTION OF THE DRAWINGS

Figure 1:
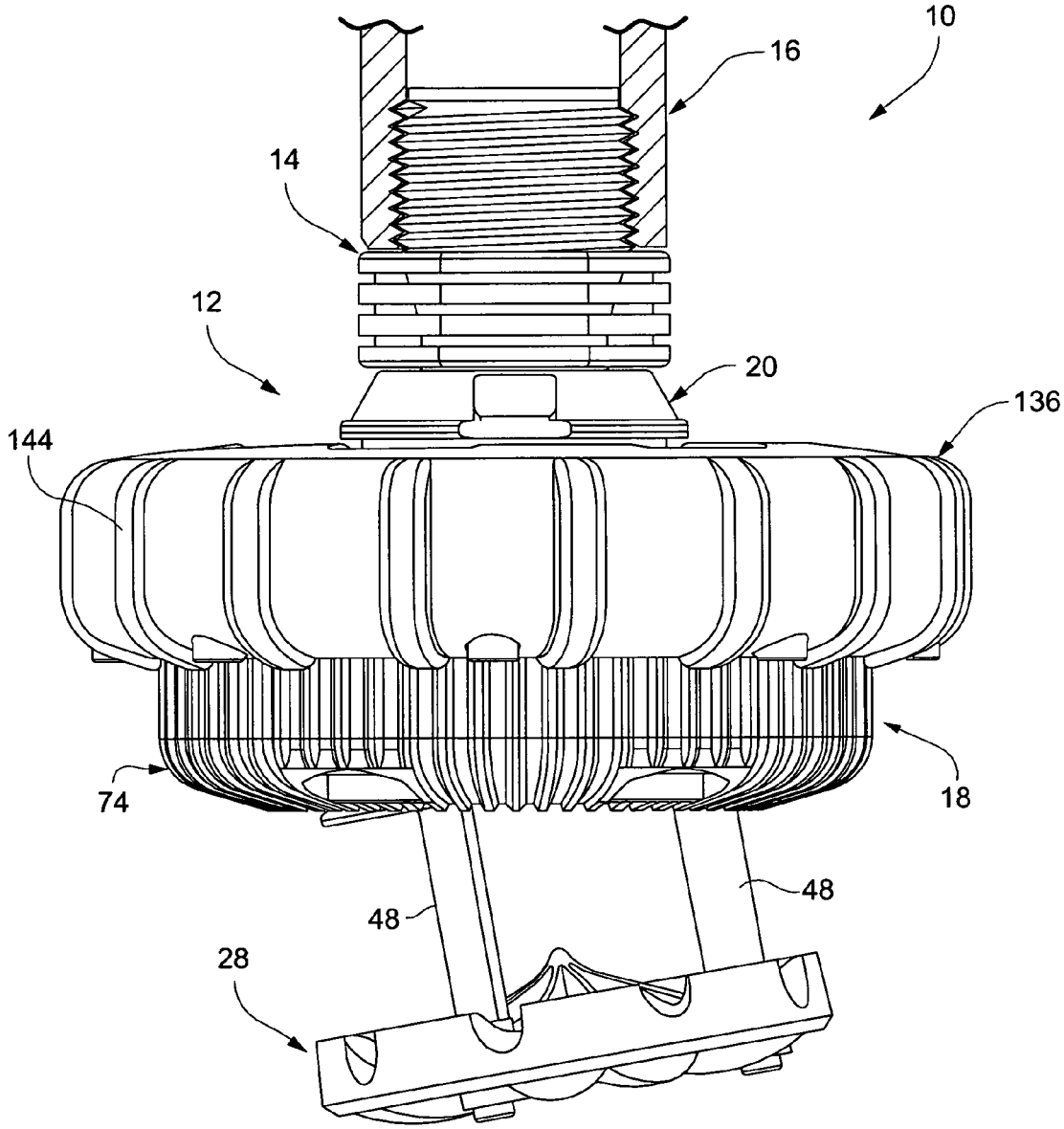
FIG. 1 is a front elevation of a sprinkler head in accordance with a first exemplary embodiment, with an optional weight attached.
Figure 2:
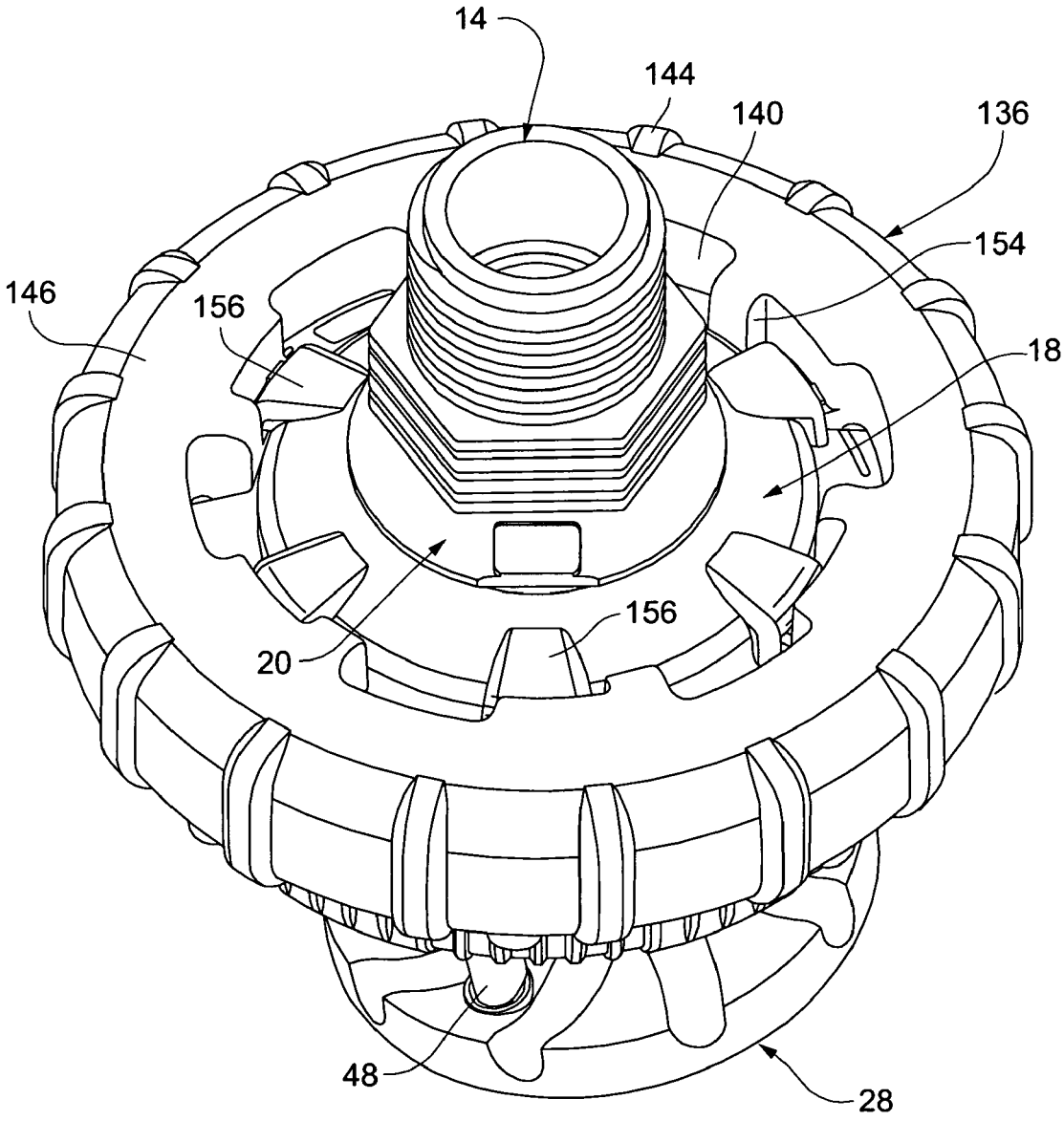
FIG. 2 is a top, front perspective view of the sprinkler shown in FIG. 1.
Figure 3:
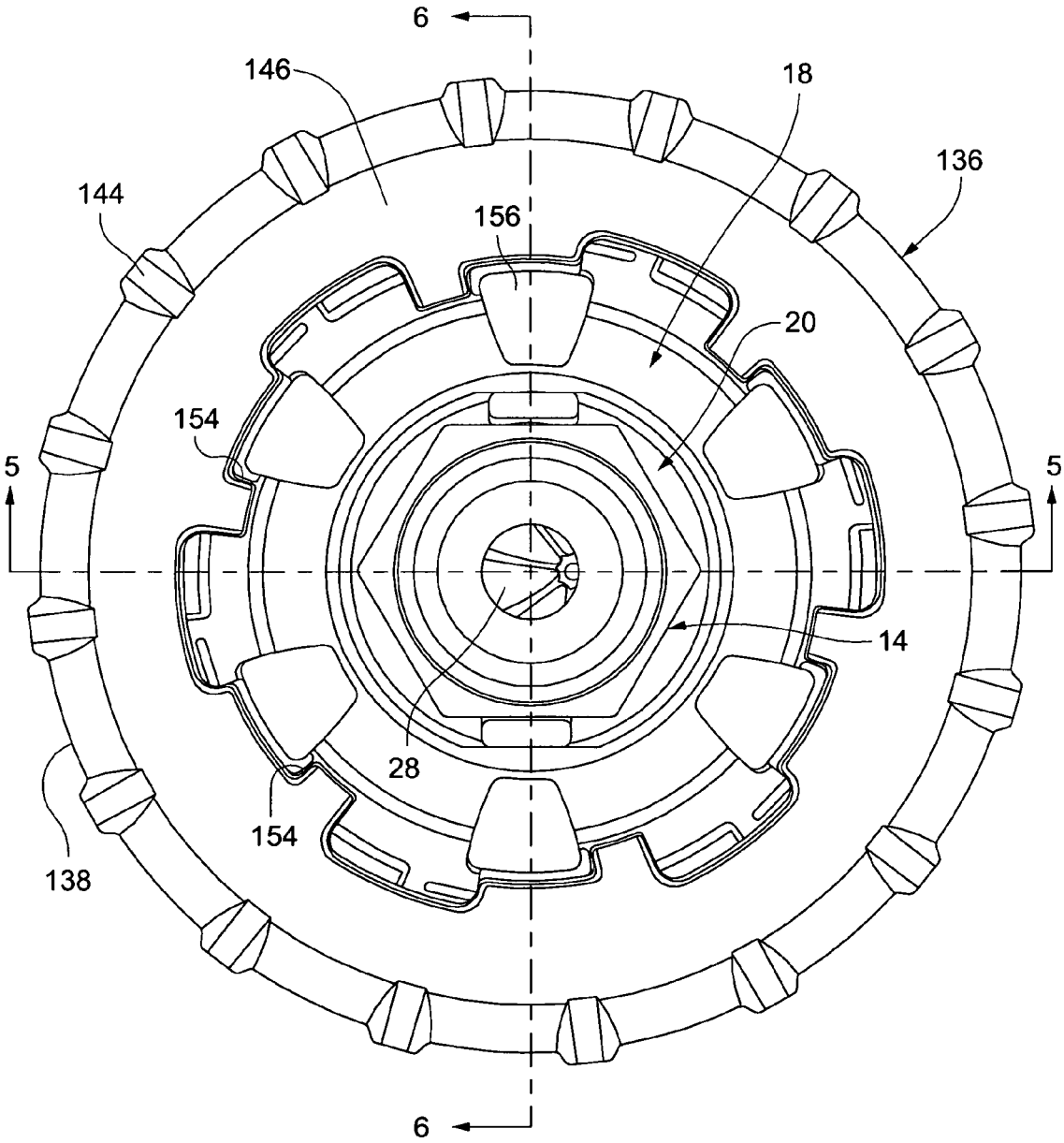
FIG. 3 is a top plan view of the sprinkler shown in FIG. 1, with an associated component removed.

With initial reference to FIGS. 1-6, a sprinkler head 10 includes a sprinkler body assembly 12 made up of an adaptor 14 for securing the sprinkler head to a flexible conduit, fixed riser or other irrigation component 16; a sprinkler housing assembly 18, and a nozzle body 20. Unless otherwise specified, the various components are constructed of a hard plastic material, but other suitable materials may be employed.

Figure 5:
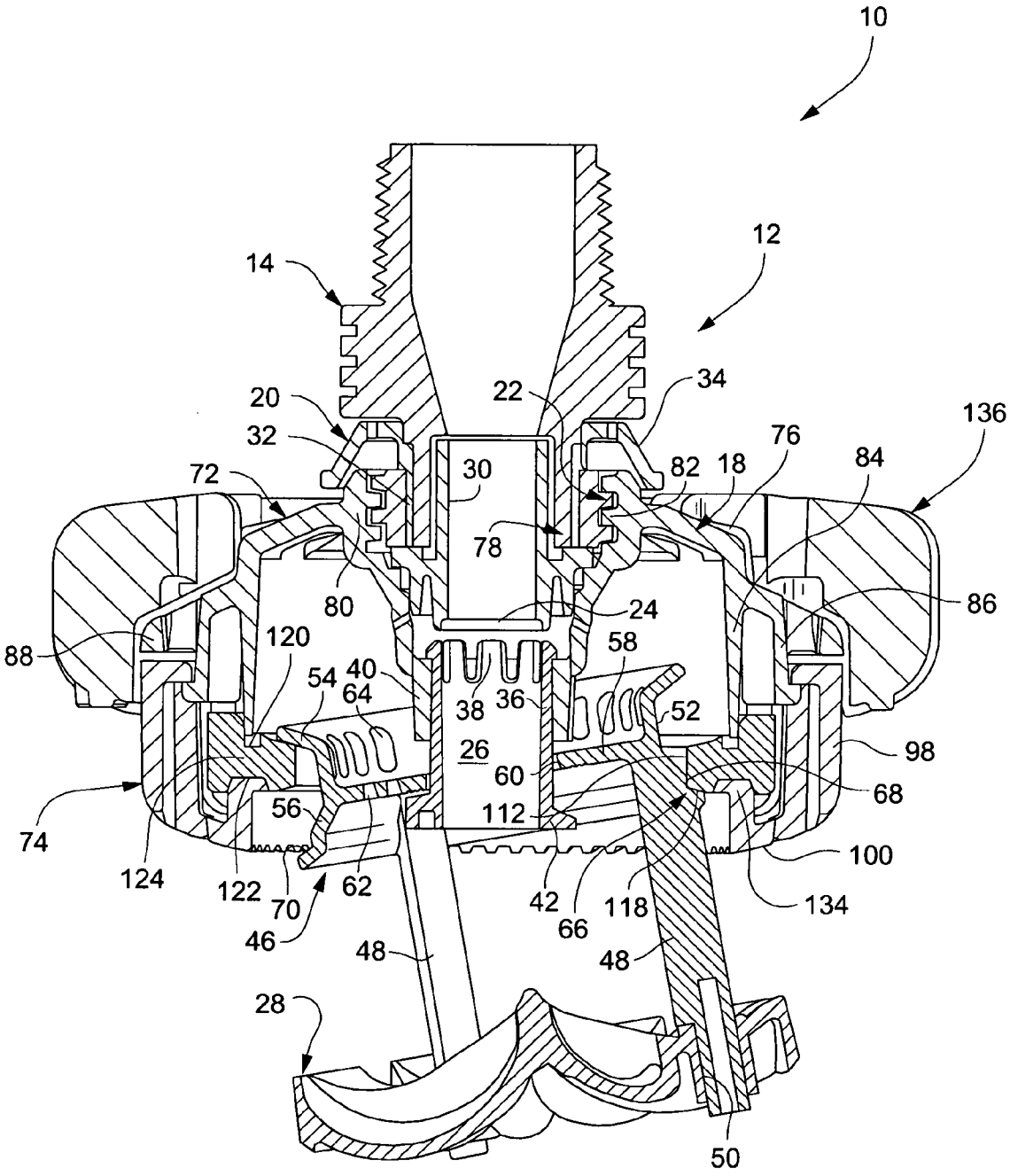
FIG. 5 is a cross section similar to FIG. 4 but with the water-deflection plate shown in an operating mode, and with the optional weight attached.
Figure 6:
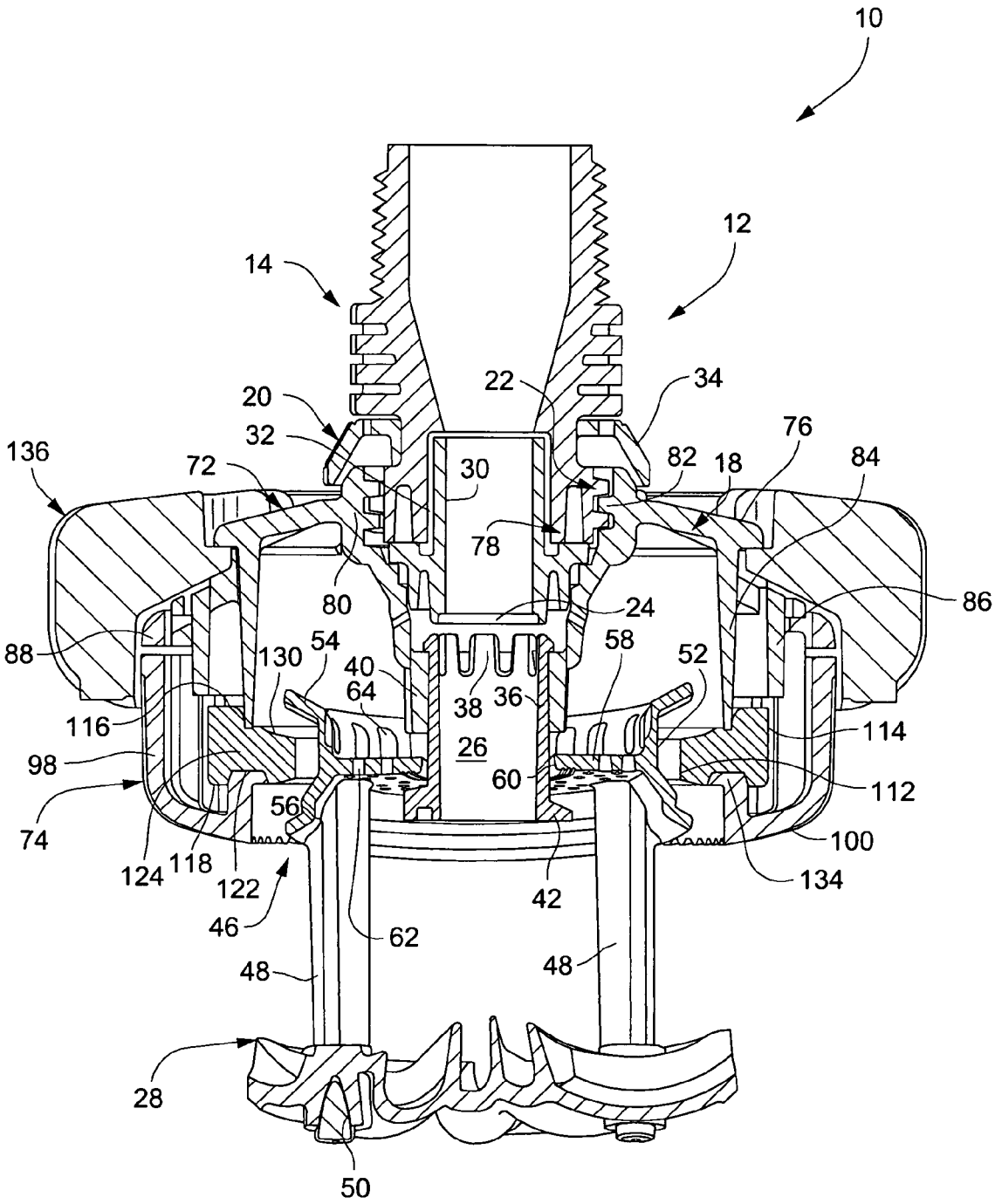
FIG. 6 is a cross section similar to FIG. 5, but with the sprinkler head rotated 90 degrees.

As best appreciated from FIGS. 1, 5 and 6, the nozzle body 20 is sandwiched between the adaptor 14 and the sprinkler housing assembly 18 which are secured together via a threaded connection at 22. The nozzle body 20 per se is of known construction, formed with an orifice 24 that emits a solid stream of water that passes through an axially adjacent starter tube 26 (also sometimes referred to as a nozzle tube) to atmosphere, and toward a water-distribution plate 28, as described further hereinbelow.

The nozzle body 20 is formed with an inner tubular portion 30 that terminates in a downstream direction at the orifice 24. A radially outer tubular portion 32 extends in an upstream direction to a conical ring flange 34 that is visible to the user, and that may have nozzle size and/or performance information thereon. It will be appreciated that the nozzle body 20 is easily removed and replaced by the same or different-size nozzle, simply by unscrewing the adaptor 14 and lifting the nozzle.

Figure 7:
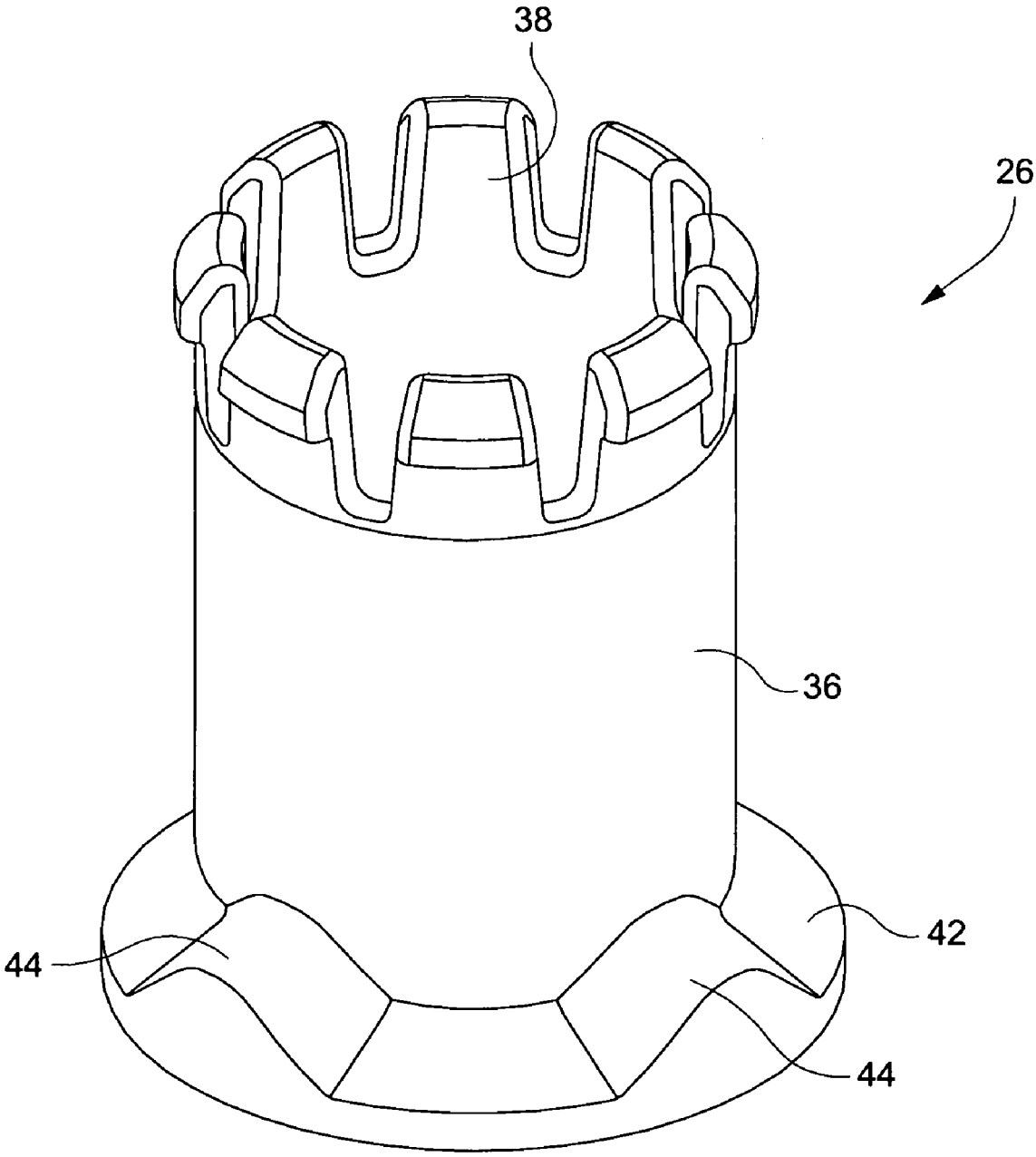
FIG. 7 is a perspective view of a starter tube component removed from the sprinkler head shown in FIGS. 1-6.

With reference also to FIG. 7, the starter tube 26 is formed with a substantially cylindrical tubular portion 36 formed with resilient, upstanding spring fingers 38 about the upstream peripheral edge thereof. These fingers permit resilient attachment of the starter tube 26 to an inner tubular portion or hub 40 of the sprinkler housing assembly 18. The downstream end of the starter tube is formed with an outwardly directed radial flange 42 having a pair of lugs or ribs 44 spaced circumferentially on the flange by about 90 degrees. The function of the lugs or ribs 44 will be described in further detail below. It will be appreciated that the nozzle orifice could also be located at the downstream end of the starter or nozzle tube.

Figure 4:
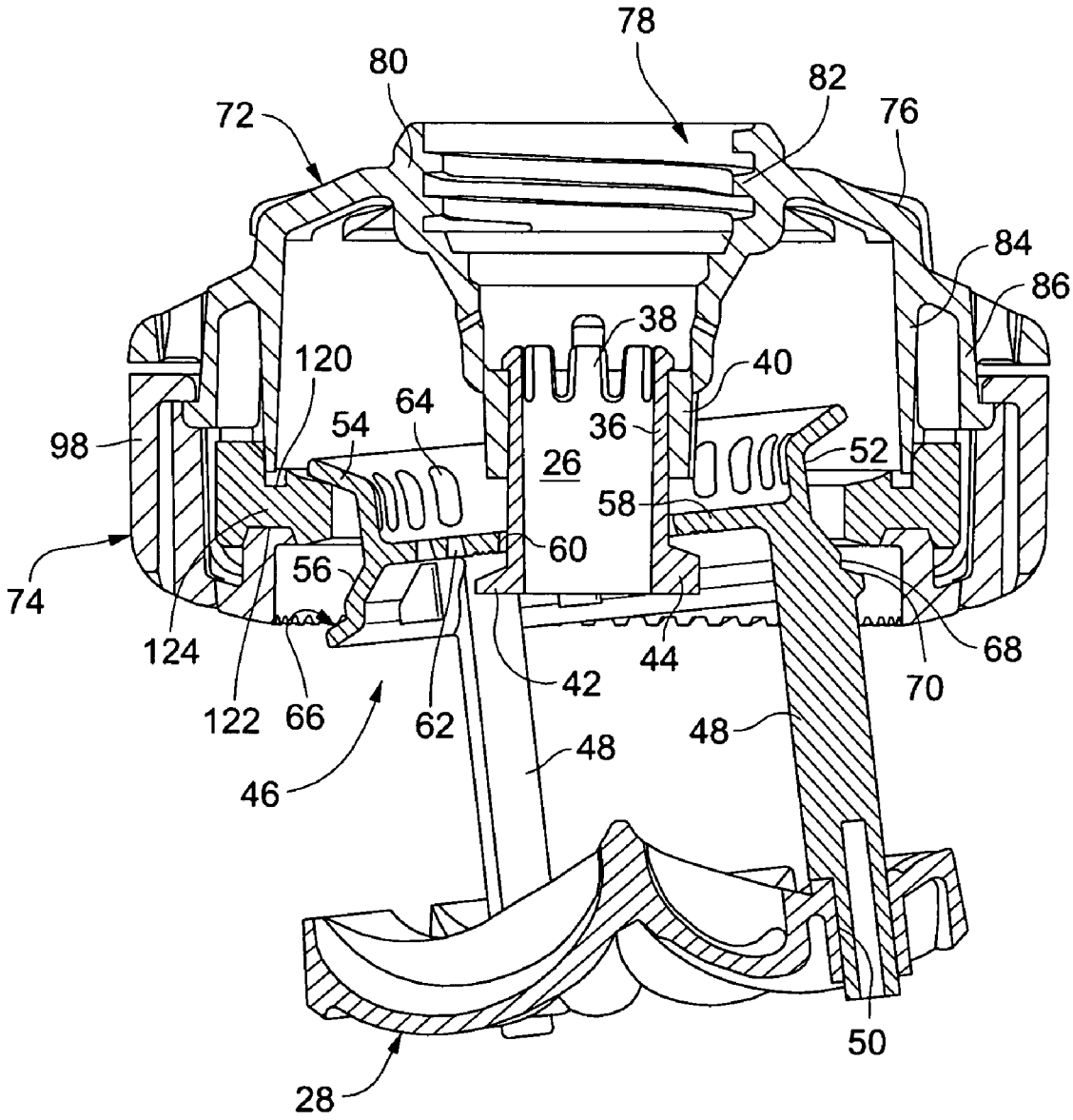
FIG. 4 is a cross section taken along the longitudinal center axis of the sprinkler head in FIG. 1, with the water-deflection plate shown in a start-up mode, and with the adaptor, nozzle and optional weight removed.

The water-deflection plate 28 is carried by a double-flanged spool 46 via three circumferentially-spaced struts 48 (this assembly of the water-deflection plate 28, struts 48 and spool 46 may also be described as a "cage"). The struts 48 extend through apertures 50 formed in the water-plate 28, and the plate may be attached to the struts 48 by screws or other fasteners (not shown), or by means of, for example, heat and pressure applied to the tips of the struts, i.e., by heat staking. The opposite ends of the struts 48 may be formed integrally with the spool as best seen in FIGS. 4-6.

Figure 12:
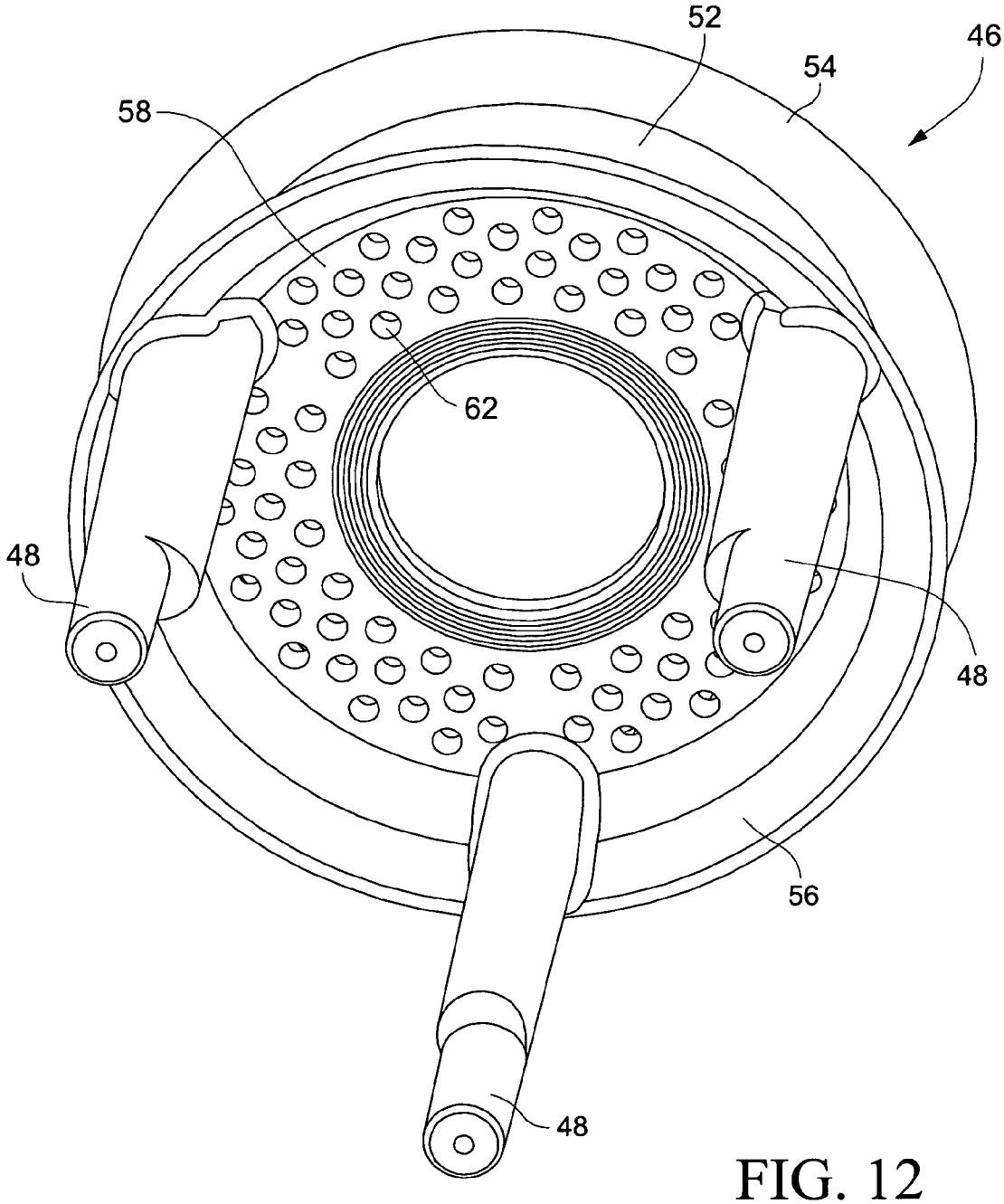
FIG. 12 is a lower perspective view of a spool component removed from the sprinkler head shown in FIGS. 1-6.

With reference also to FIG. 12, the double-flanged spool 46 includes a generally cylindrical wall 52 with upper and lower annular flanges 54, 56, respectively. A center disc 58 is located approximately midway along the height of the spool 46 at the base of the cylindrical wall 52, with a center aperture 60 sized to loosely receive the cylindrical tubular portion 36 of the starter tube 26. In this way, the spool 46 and water-deflection plate 28 are loosely supported on the flange 42 of the starter tube 26 in a tilted or off-axis orientation due to engagement of the disc 58 with one or both of the lugs or ribs 44, as best seen in FIG. 4.

Note also that as a weight-reducing feature, the center disc 58 may be formed with a plurality of holes 62, and the inside surface of at least the upper flange 54 may be formed with a series of axially-oriented and substantially parallel grooves or flutes 64.

The upper spool flange 54 extends upwardly and outwardly from the upper end of the wall 52 at an angle of about 45 degrees. The lower spool flange 56 extends downwardly and outwardly from the base of the wall 52, also at an angle of about 45 degrees. A remote end of the flange 56 is formed with an annular notch or shoulder 66 formed by first and second annular surfaces 68, 70 (best seen in FIG. 4) the function of which will be described further below.

Figure 8:
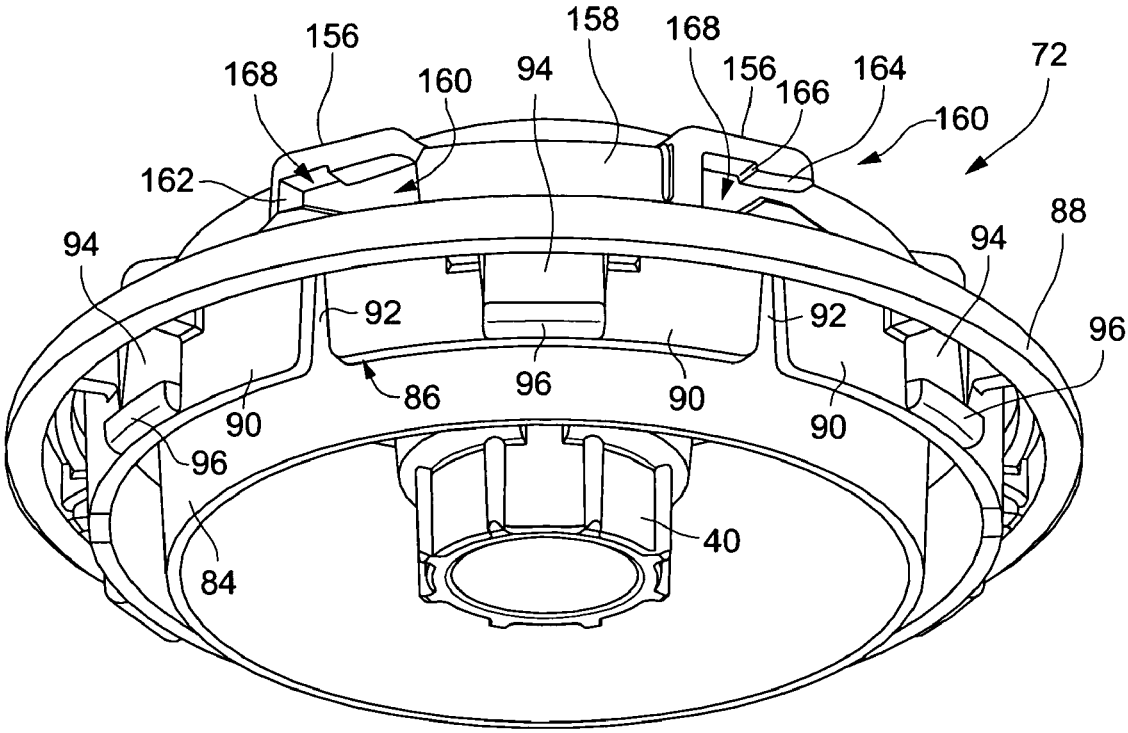
FIG. 8 is a lower front perspective view of an upper body component removed from the sprinkler head shown in FIGS. 1-6.
Figure 9:
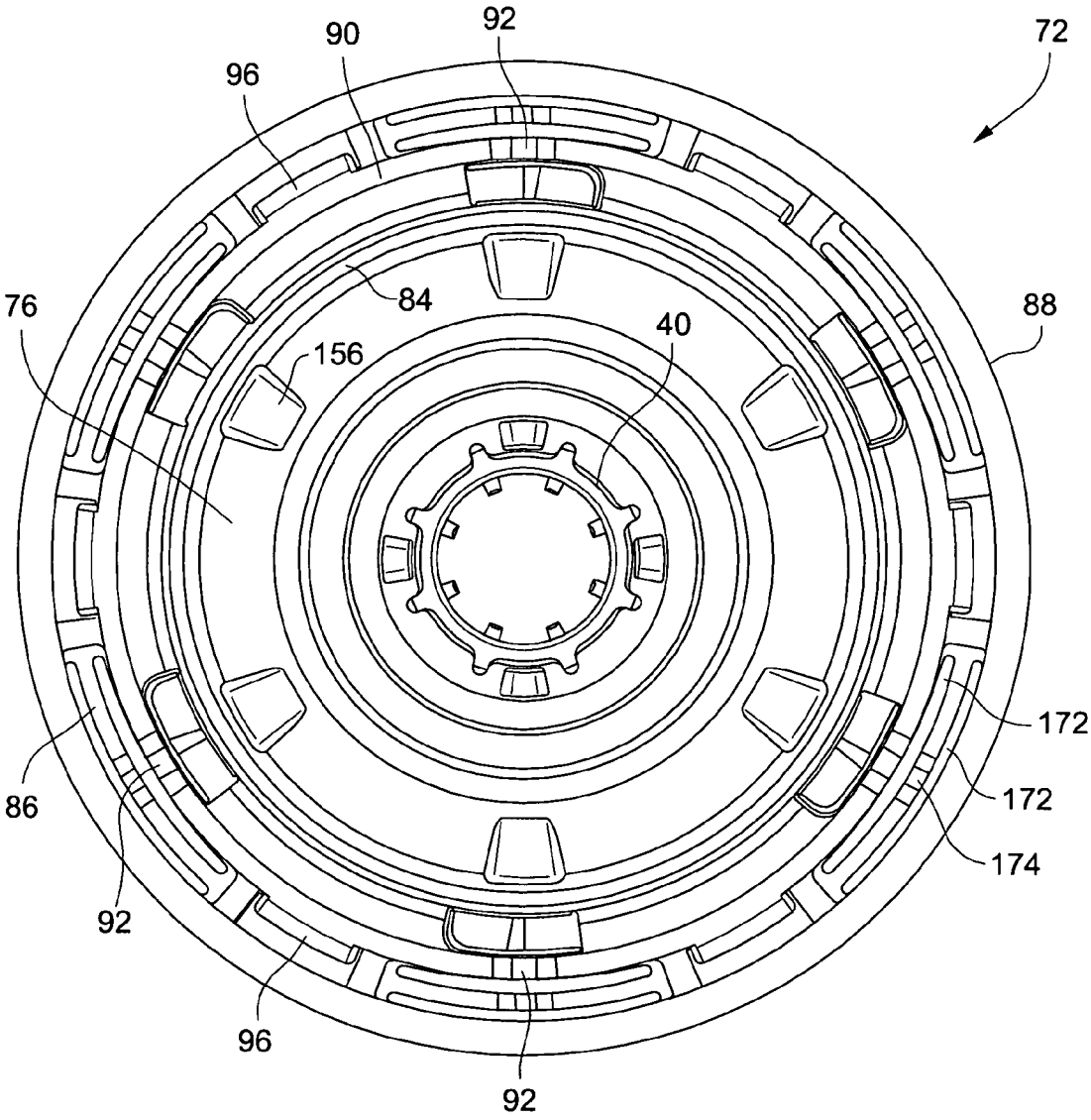
FIG. 9 is a bottom plan view of the upper body component shown in FIG. 8.

With particular attention to FIGS. 4-6, the sprinkler housing assembly 18 includes upper and lower body components 72, 74, respectively. The upper body component 72 of the housing assembly 18 includes an outer wall 76 formed at its upper end with a threaded center opening 78 defined by a radially inner wall 80. Below the threads 82, the wall 80 tapers inwardly to join with the hub 40. With additional reference to FIGS. 8 and 9, the upper body component 72 also includes a pair of substantially parallel, radially-spaced intermediate walls 84, 86 and an outer annular skirt or rim 88. The outer intermediate wall 86 is made up of plural arcuate segments 90 separated by vertical slots 92. Each segment 90 has its own resilient spring finger 94 formed with a radial outward flange or tab 96 at its lower edge. The inner intermediate wall 84 is an annular, solid wall that extends vertically downward a distance greater than the outer intermediate wall 86.

Figure 13:
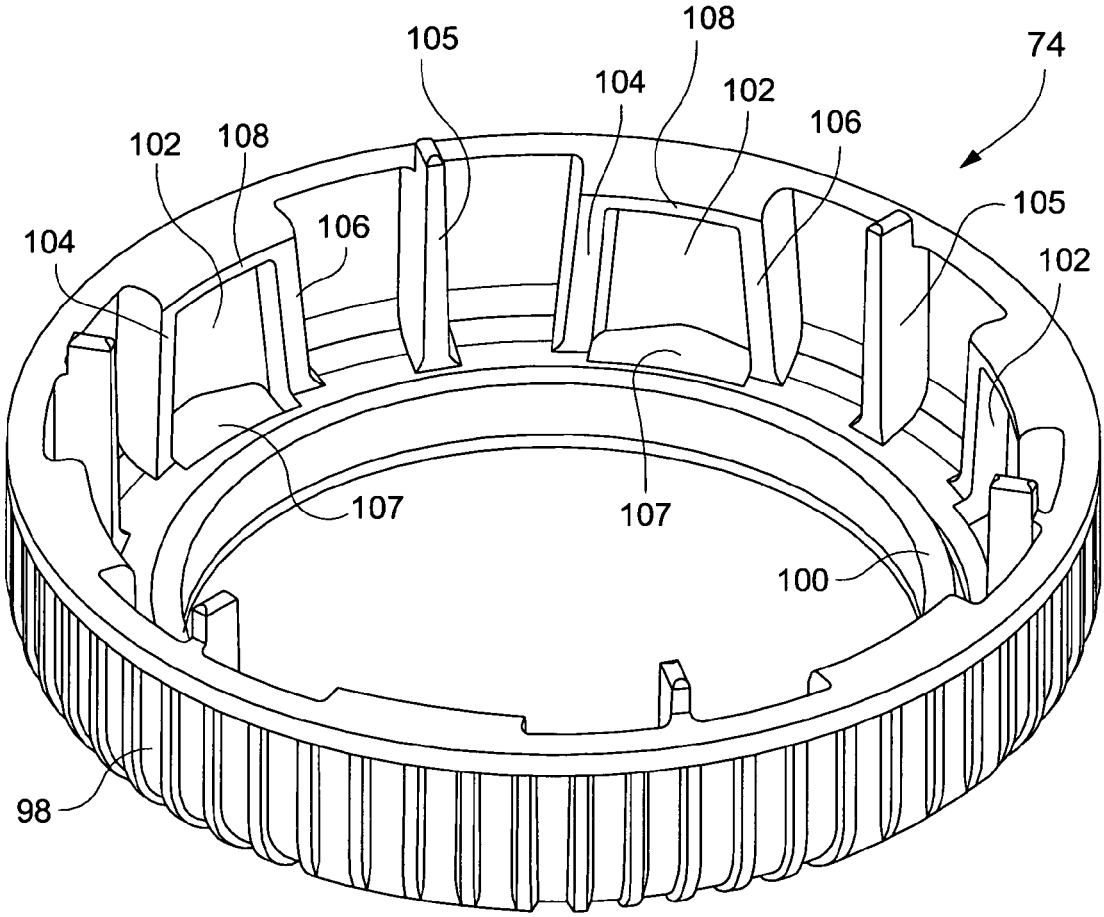
FIG. 13 is an upper front perspective view of an upper body component removed from the sprinkler shown in FIGS. 1-6.
Figure 14:
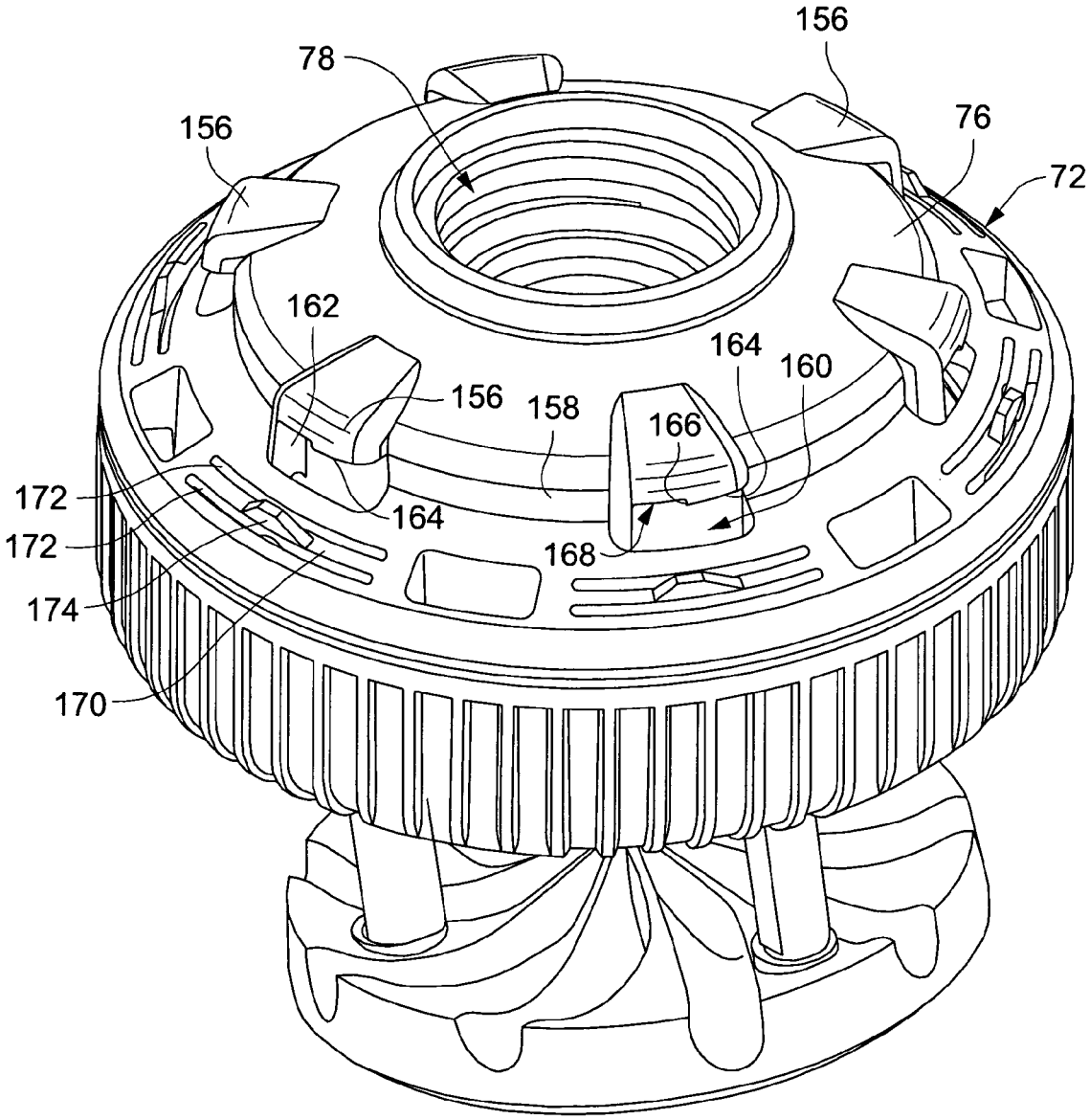
FIG. 14 is a top, front perspective view of the sprinkler head, similar to FIG. 2, but with a weight component removed from the head.

With continued reference to FIGS. 4-6, and with further reference to FIG. 13, the lower body component 74 is an annular ring-like member, with an outer peripheral wall 98 formed at its lower edge with an in-turned rim or flange 100. The wall 98 is formed with circumferentially-spaced pockets or recesses 102, each defined by a pair of inwardly-directed side ribs 104, 106, connected by an inwardly-projecting roof surface 108 that is flush with the upper edge of the wall 98. The spaces between adjacent pockets or recesses 102 are bifurcated by vertical ribs 105 that extend from the rim or flange 100 in an upward direction, beyond the upper edge of the wall 98. Apertures 107 at the base of pockets 102 are provided as a manufacturing feature, facilitating the molding of the component.

It will be appreciated that the lower body component 74 can be secured to the upper body component 72 by aligning the pockets 102 with the spring fingers 94 and pushing the two body components together, such that the tabs 96 snap over the roof surfaces 108, allowing the ribs 105 to be received within the slots 92. It should be noted that the outer contours of the upper and lower body components are shaped such that any water running down the outside of the housing 18 will tend to remain attached to the housing especially at the lower end of the lower body component 74, where the water will flow inwardly along the underside of the rim 100 before falling into an area where the emitted streams will carry the excess water radially outwardly with the nozzle streams, thereby minimizing undesirable "drooling" of excess water directly beneath the sprinkler head.

Figure 10:
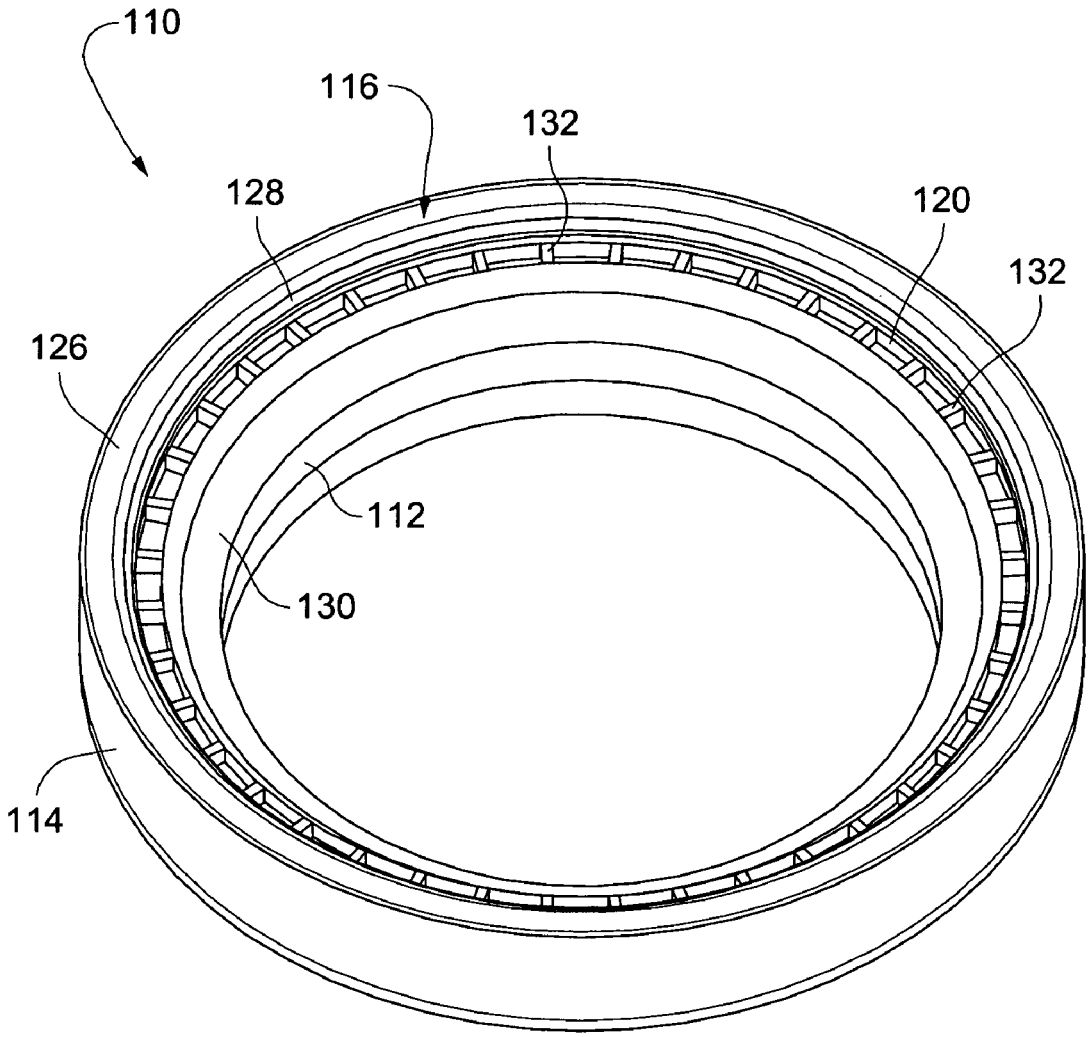
FIG. 10 is a top perspective view of a race component removed from the sprinkler head shown in FIGS. 1-6.
Figure 11:
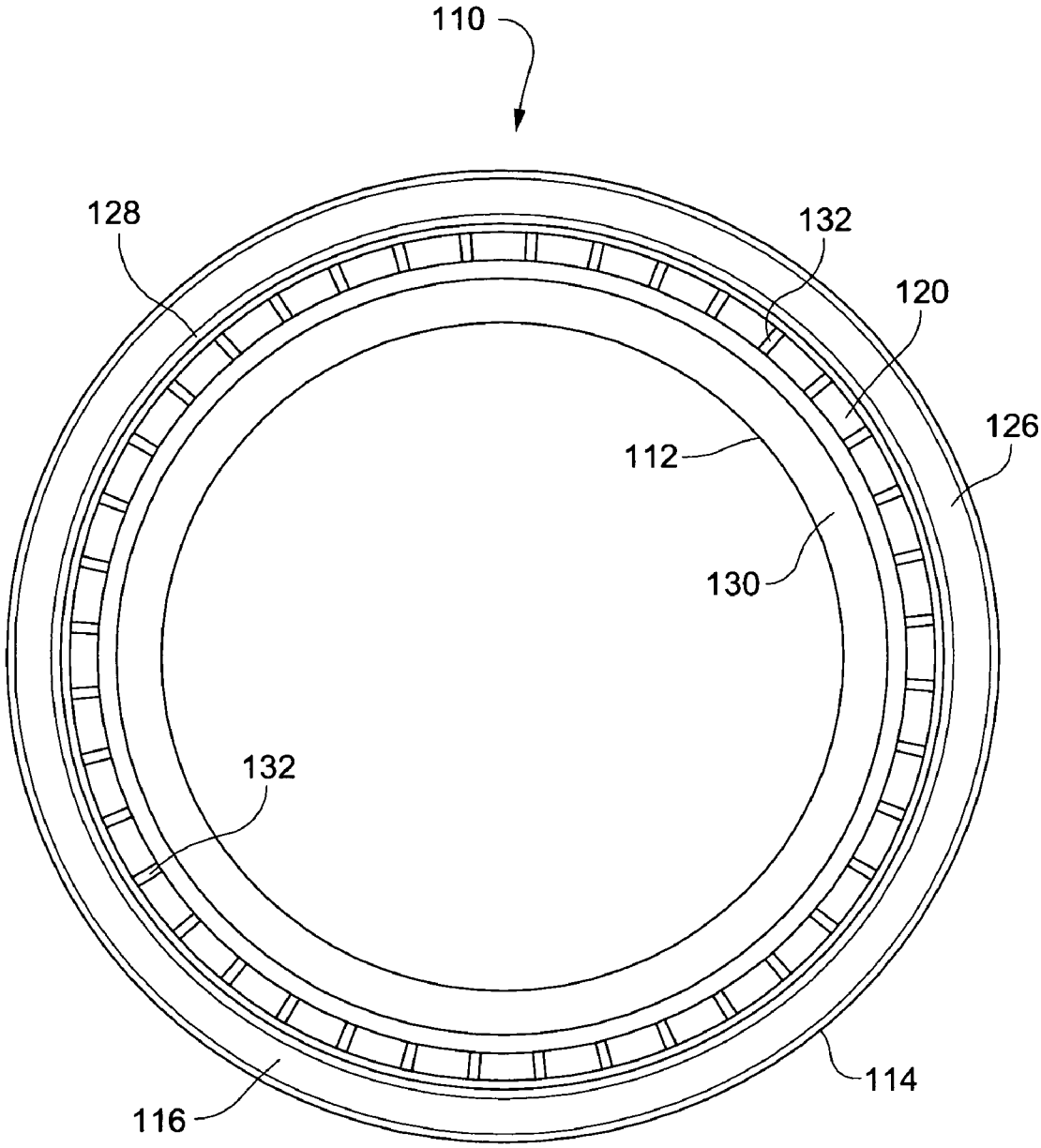
FIG. 11 is a top plan view of the race component shown in FIG. 10.

With continuing reference to FIGS. 4-6, and with reference also to FIGS. 10 and 11, an annular race 110 is secured between the upper and lower body components 72, 74. The race 110 is preferably made of a polyurethane material, for example, a 55D Durometer polyurethane available under the trade name Dow Pellathane. The race 110 is formed with radially inner and outer surfaces 112, 114, respectively. Respective upper and lower surfaces 116, 118 of the race are formed with opposed grooves 120, 122 that create a narrow neck portion 124 between the inner and outer surfaces 112, 114. More specifically, the upper surface 116 is formed with a radially outer flat surface 126 joined to a tapered surface 128 that lies immediately adjacent the radially outer edge of the groove 120. A second tapered surface 130 extends from the radially inner edge of the groove to the inner edge 112 of the race. The groove 120 is formed with a plurality of circumferentially-spaced, radially-oriented "crush ribs" 132, best seen in FIGS. 10 and 11. The groove 120 is otherwise sized and shaped to receive the lower end of the inner intermediate wall 84 of the upper body component 72.

The lower groove 122 is sized and shaped to receive an upper, flanged edge 134 of the radially in-turned rim 100 of the lower body component 74.

It will thus be appreciated that, upon assembly of the upper and lower body components 72, 74, the race 110 is sandwiched between the wall 84 of the upper body component 72 and the rim flange 134 of the lower body component 74. Note that the "crush ribs" 132 are engaged and compressed by the lower end of the wall 84 in a manner that provides a desirable manufacturing tolerance for the assembled parts, without otherwise damaging the race.

FIGS. 1 and 4 show the sprinkler head in an at-rest position, prior to start-up. Note that the engagement of the spool disc 58 with one or both of the lugs or ribs 44 maintains the spool 46 (and hence the water-deflection plate 28) in a tilted or offset position relative to a vertical center axis through the sprinkler head. This tilt insures immediate wobbling or nutating action when the water-deflection plate 28 is impinged upon by a stream under pressure emitted from the nozzle 20. As best seen in FIG. 4, in the at-rest position, an arcuate segment of the undersurface of the upper spool flange 54 engages the tapered surface 130 of the race 110 at its interface with inner surface 112. At the same time, the lower flange 56 of the spool is not engaged at any point with the race.

The sprinkler head is shown from the same perspective, but in an operation mode in FIG. 5. Here, the spool 46 lifts off the ribs or lugs 44 on the starter tube 26, and the undersurface of the upper spool flange 54 slides slightly along the race 110, while the shoulder 66 on the lower spool flange 56 now engages the lower corner of the race, i.e., portions of the inner surface 112 and lower surface 118. More specifically, the inner surface 112 and a radially inner portion of the lower surface 118 of the race 110 are shaped to substantially match the surfaces 68, 70 of shoulder 66 to provide positive engagement with the race at the point where the spool 46 takes the side load during the wobbling action. In addition, and in order to enhance traction between the spool flanges and the race, the radially inner surface 114, upper surface 130 and the radially inner portion of the lower surface 118 of the race 110 may be textured, by, for example, acid-etching the corresponding surfaces of the mold used to manufacture the race. It will be understood, however, that other suitable texturing or surface roughening techniques may be used. At the same time, the surfaces 68, 70 of the shoulder 66 on the lower spool flange 56 may be similarly textured or otherwise roughened. The underside of the upper spool flange 54, however, is not textured, facilitating a smooth start-up.

During operation, when a stream emitted from the nozzle 20 impinges on the plate 28, the plate and the spool 46 will nutate (i.e., wobble and rotate) about the center vertical axis of the sprinkler. During this motion, the underside of the upper flange 54 will engage the upper surface of the race 110, while the upperside of the flange 56 will engage the lower surface of the race at generally diametrically opposed locations as described above. Note, however, that after the initial start-up, the spool disc 58 will not engage the lugs 44 of the starter tube 26.

Figure 15:
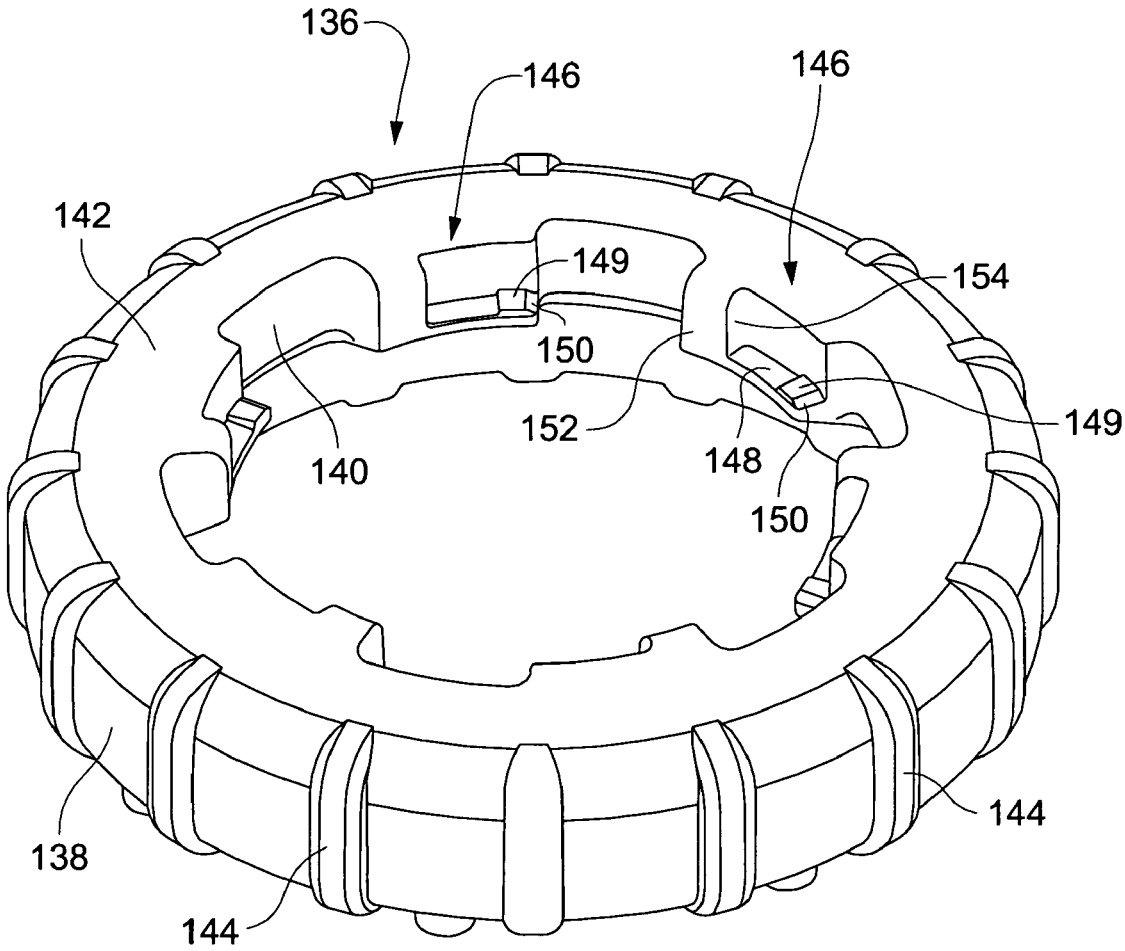
FIG. 15 is a top front perspective view of the optional weight component.

At various times, and under certain weather conditions (e.g., high winds), it may be desirable to add a weight to the sprinkler head to minimize the lateral swinging motion of a flexible drop hose to which the sprinkler head may be attached. FIGS. 1-3, 5, 6, and 15 illustrate a suitable weight 136 which may be attached to the sprinkler head. With reference initially to FIG. 15, the weight 136 is substantially donut-shaped, having an outer peripheral wall 138 and an inner peripheral wall 140, joined by a top surface 142. The weight may be of any suitable material, but the presently preferred material is a solid zinc die-casting. The outer peripheral wall 138 may be formed with circumferentially-spaced, vertical ribs 144 which facilitate attachment and detachment of the weight as described further below.

The inner peripheral wall 140 may be formed with attachment features for securing the weight to the sprinkler head with, for example, a bayonet-type attachment. More specifically, the inner peripheral wall 140 is formed with plural, circumferentially-spaced attachment segments 146 that project radially inwardly. Each attachment segment 146 includes a horizontal shelf or ledge 148 formed with a projection 149 having ramped entry surface 150 that is raised slightly relative to the remainder of the shelf. Opposite the ramped entry surface 150, there is a boss or lug 152 presenting a vertical stop or limit surface 154. The inner peripheral wall 140 and attachment segments 146 have a height dimension about half that of the outer peripheral wall, such that the weight 136 can fit over the top of the sprinkler head, while partially enclosing the upper body component 72.

Turning to FIGS. 2, 3, 8 and 14, the upper portion of the outer wall 76 of the upper housing body 72, adjacent the center opening 78, is formed with plural, circumferentially-spaced attachment bosses 156, the radially outer end of each boss extending beyond an annular vertical step 158 in the outer wall 76, creating an attachment region 160, bounded on one side by a radially-oriented vertical stop edge 162. The underside of the boss 156 defining the top of the attachment region, is formed with a ramped surface 164, terminating at an edge 166, leaving a recess 168 between the edge 166 and the stop edge 162. On the outer wall 76, radially outwardly of both the annular step 158 and the bosses 156, there are a corresponding number of flexible spring strips 170, as defined by adjacent arcuate slots 172, each strip having a raised tab 174. The spring strips 170 and tabs 174 are radially aligned with respective bosses 156, and are adapted to interact with the attachment segments 146 of the weight 136 as described below.

To attach the weight 136 to the sprinkler head 10, the weight is telescoped over the head, with the attachment segments 146 located circumferentially between the attachment bosses 156. The user may then press the weight downward and rotate the weight (with ribs 144 facilitating a good grip), such that the ramped entry surface 150 on the weight rides over the ramped surface 164 on the upper sprinkler component 72 until the projection 149 snaps into the recess 168. During the described rotation, the tabs 174 of spring strips 170 bias the weight upwardly within the attachment regions 168 of the upper housing component 72.

It will be appreciated, however, that the weight and sprinkler head may be secured in any conventional quick-connect/disconnect fashion as understood by those of ordinary skill in the art.

Figure 16:
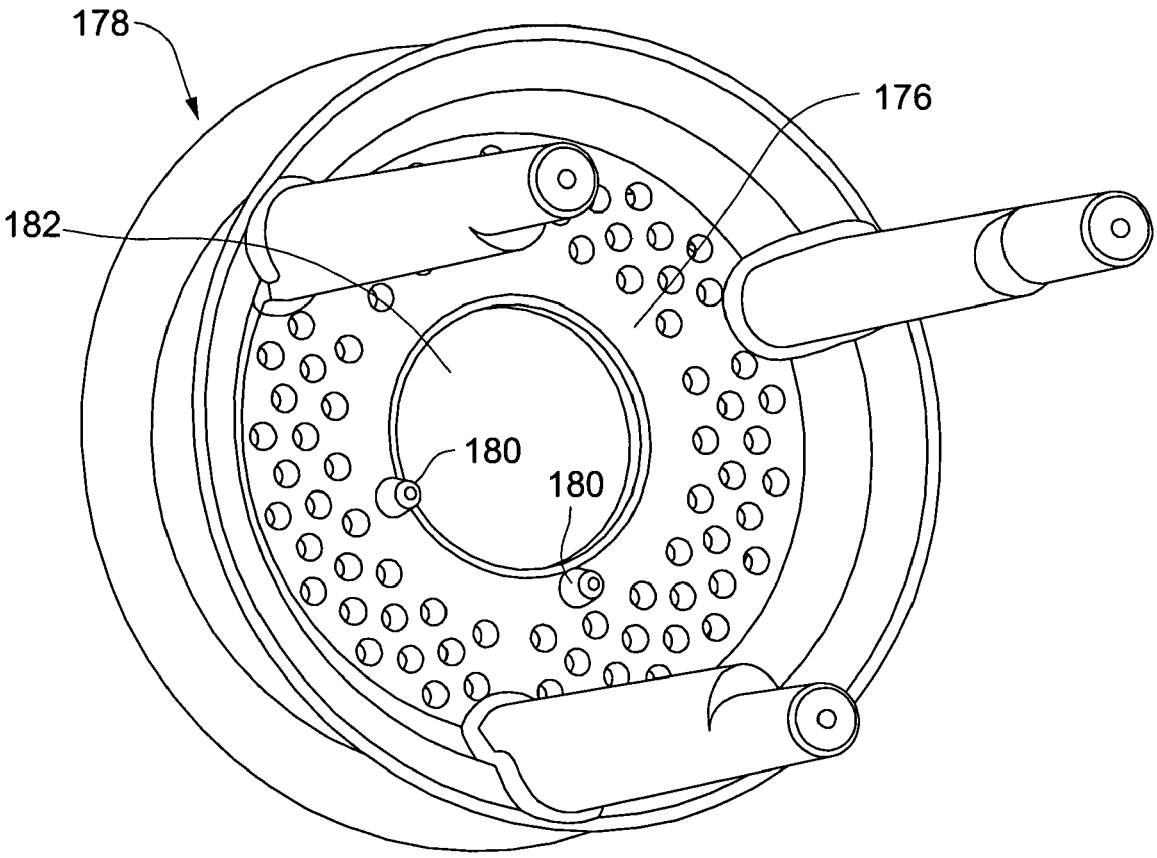
FIG. 16 is a perspective view of an alternative spool component in accordance with another exemplary embodiment of the invention.

FIG. 16 shows an alternative tilt arrangement where the lugs used to insure that the spool and deflection plate remain tilted when at rest are moved from the starter tube to the spool. More specifically, the underside of the center disc 176 of a spool 178 is formed (or provided) with a pair of lugs or starter bumps 180 adjacent the center opening 182, and circumferentially spaced by, e.g., about 90 degrees. These lugs or bumps will engage the flange 42 of the starter tube 26, causing the spool 178 to tilt in substantially the same manner described above.

Figure 17:
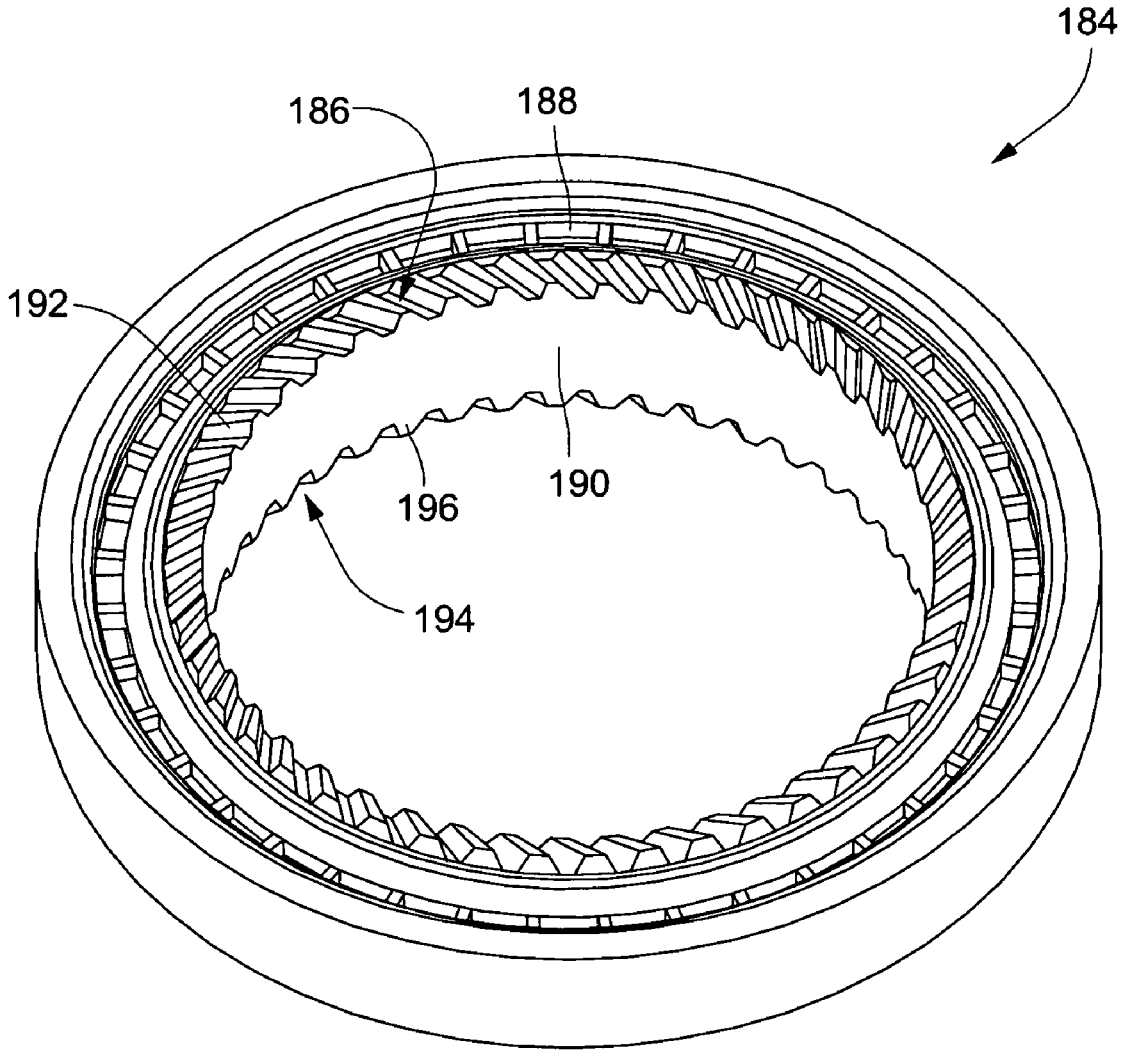
FIG. 17 is a perspective view of a race component in accordance with another exemplary embodiment of the invention.

FIG. 17 shows an alternative to the race 110. Here, the race 184 is formed with a radially inner top surface 186, extending between the inner edge of the ribbed assembly groove 188 and the radially inner edge 190 of the race. Surface 186 is formed with a plurality of angled, upstanding ribs 192. These ribs function similarly to the textured surface 128 on the race 110. In addition, the lower surface 194 of the race is formed with a similar plurality of ribs 196 for providing enhanced traction with the lower spool flange during operation. The race 184 is otherwise substantially similar to race 110.

Figure 18:
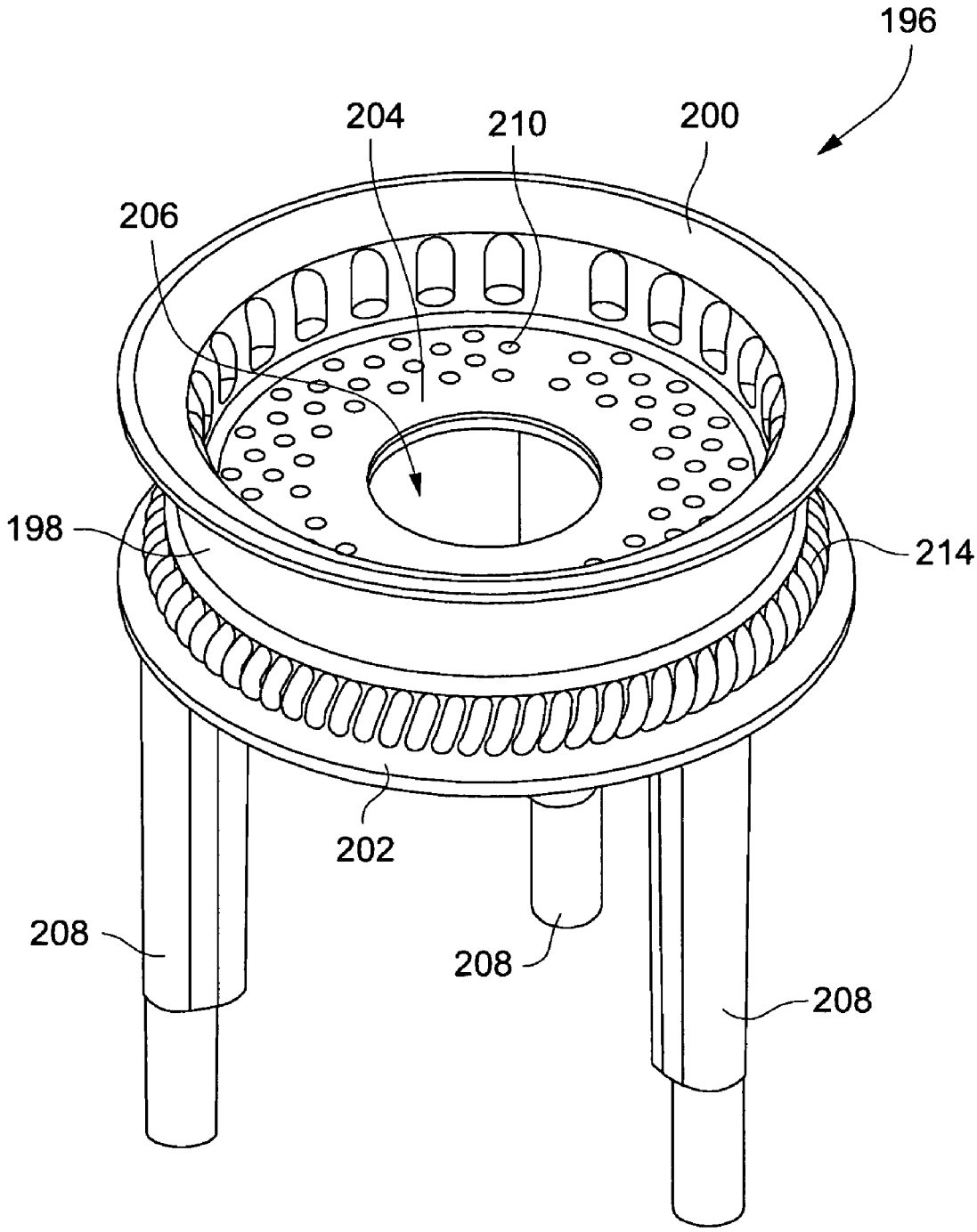
FIG. 18 is a perspective view of a spool component in accordance with another and preferred embodiment.

Turning to FIG. 18, a spool 196 in accordance with a preferred embodiment of the invention is illustrated. The spool 196 includes a generally cylindrical wall or hub 198 with upper and lower flanges 200, 202, respectively. A center disc 204 is located approximately midway along the height of the wall or hub 198. The center disc 204 is formed with a center aperture 206 sized to loosely receive the tubular portion 36 of the starter tube 26 as described in connection with the earlier-described embodiments. Support struts 208 extend from the spool and carry the water-deflection plate, and weight-reducing holes 210 and grooves or flutes 211 are also provided as in the earlier-described embodiments.

In this embodiment, however, mating gear teeth are formed on the spool 196 and on a complimentary race 212 (described below). The gear teeth 214 on the spool are formed at the juncture of the cylindrical wall or hub 198 and the lower spool flange 202. The teeth are very shallow and highly rounded so as not to be susceptible to jamming by debris, such as sand particles or the like.

Figure 19:
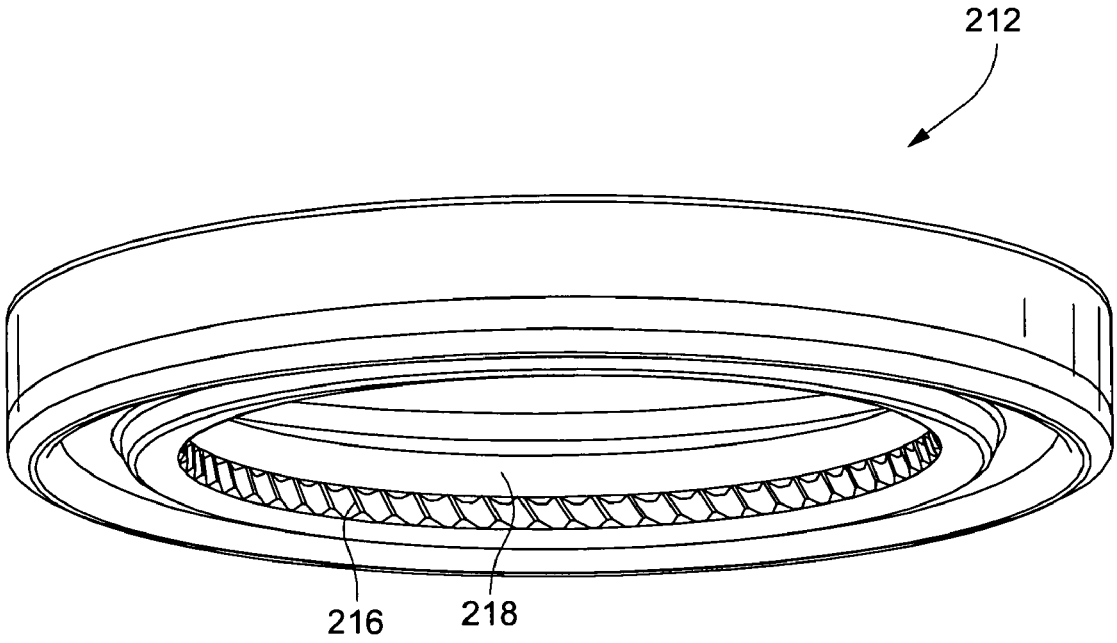
FIG. 19 is a perspective view of a race component in accordance with the preferred embodiment, especially useful with the spool shown in FIG. 18.
Figure 20:
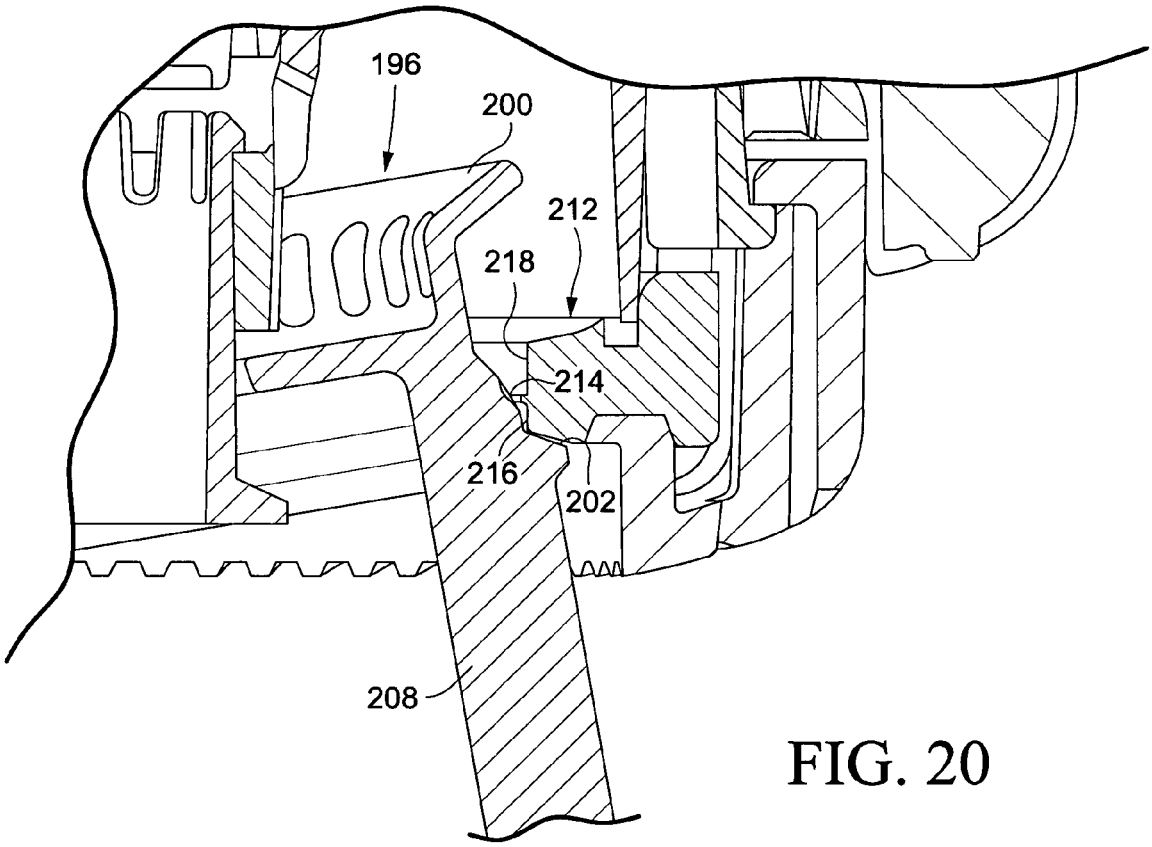
FIG. 20 is a partial section view showing in use engagement between the spool of FIG. 18 and the race of FIG. 19.

The spool 196 is designed for use with the race 212 shown in FIG. 19. Race 212 is substantially similar to the race 110 shown in FIG. 10, but with gear teeth 216 formed on the lower half of the radially inner surface 218. The gear teeth 216 are shaped to mate with the gear teeth 214 on the spool 196 during the rotation and wobbling (nutating) motion of the spool 196 and water-deflection plate.

Because the gear teeth 214 lie on a smaller diameter than gear teeth 216, there are fewer teeth on the spool 196 than on the race 212. Therefore, as the spool gear teeth 214 roll about the race gear teeth 216, the spool and water-deflection plate assembly will rotate slowly in a clockwise direction (as viewed from the bottom).

In the illustrated embodiment, the spool 196 has 62 teeth and the race 212 has 64 teeth so that for every wobble, the spool and water deflection plate assembly rotate two teeth, or for every 31 wobbles, the spool and water-deflection plate assembly will rotate one revolution. This "secondary" rotation is important to prevent "spoking" of the pattern.

When the unit is in the start-up mode, the gear teeth 214 and 216 are disengaged and thus have no effect on the start-up event. In the operational mode, however, and when viewed from the bottom, i.e., below the sprinkler, the grooves in the water deflection plate are shaped such that the unit will wobble in a counter-clockwise direction, but the torque from the water leaving the grooves is applied in a clockwise direction. The spool 196 is designed to have rolling contact with the race 212 for long wear life, but in certain "slick" water conditions, significant slippage could occur in the clockwise direction absent the mating gear teeth, potentially causing rapid wear of the interactive surfaces of the spool 196 and the race 212. In other conditions, such as sandy water, the sand may create enough friction between the spool and the race that the spool and water deflection plate assembly will not fully tilt in operation, thus causing the spool 196 to rub on the starter tube outer diameter portion 36 and the bumps 44, causing rapid wear of the starter tube 26 and spool interactive surfaces. Traction provided by the mating gear teeth 214, 216 prevents slippage, but in order for the teeth to properly engage, it is important for the spool and water deflection plate assembly to fully tilt in operation. By adding a helix to the teeth 214, 216 in the direction shown, slippage causes the teeth to drive together and thus ensure proper tilt.

An alternative but less preferred tooth arrangement would be to locate the teeth on the lower flange of the spool and on the lower face of the race component. While this arrangement works sufficiently in "slick" water conditions, it does not work satisfactorily in sandy water conditions where it does not aid in ensuring proper tilt.

Figure 21:
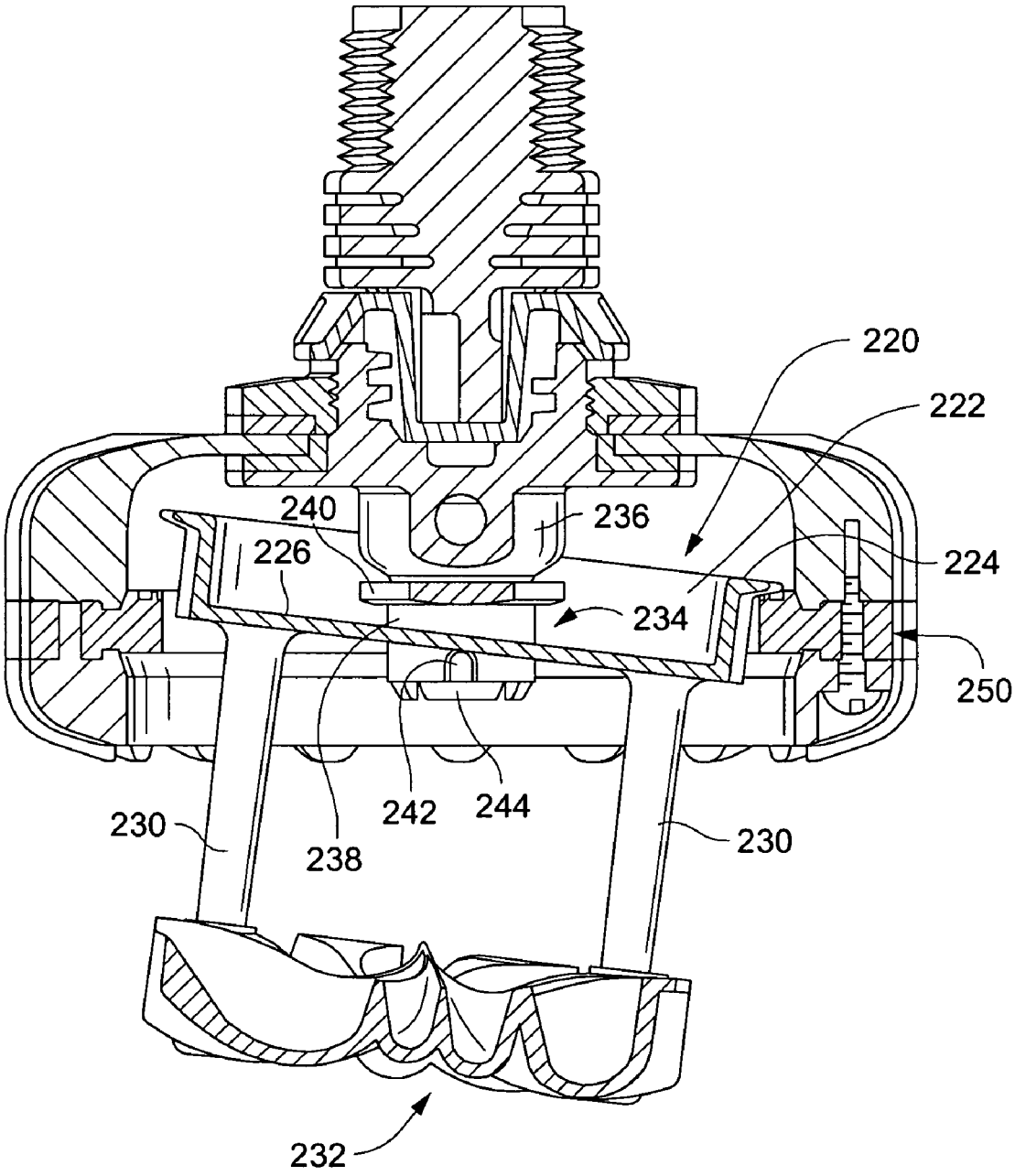
FIG. 21 is a cross section through a sprinkler head in accordance with another embodiment of the invention, shown in a start-up mode.
Figure 22:
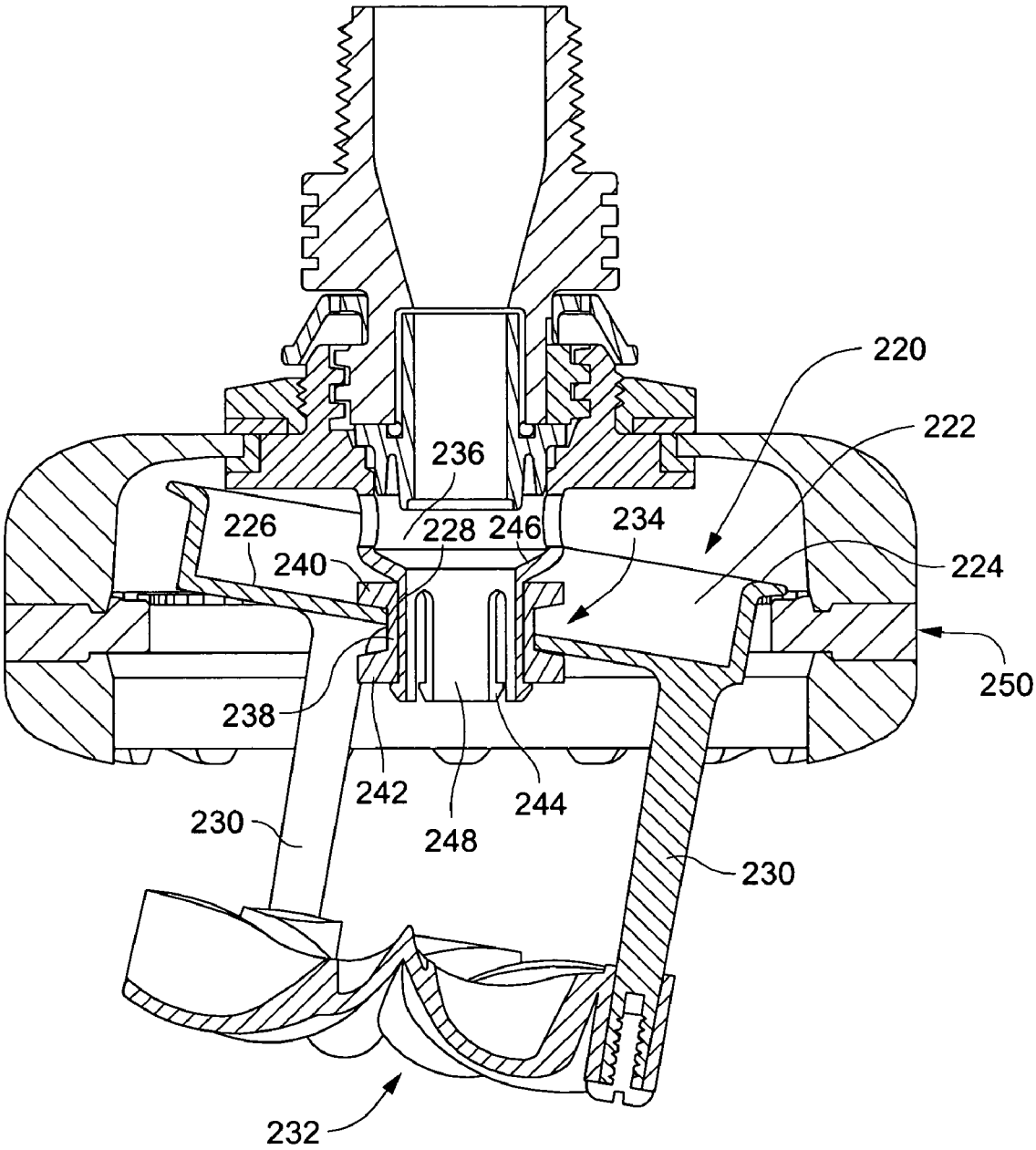
FIG. 22 is a cross section similar to that shown in FIG. 21, rotated 90° about a vertical axis in a counterclockwise direction, and in an operational mode.
Figure 23:
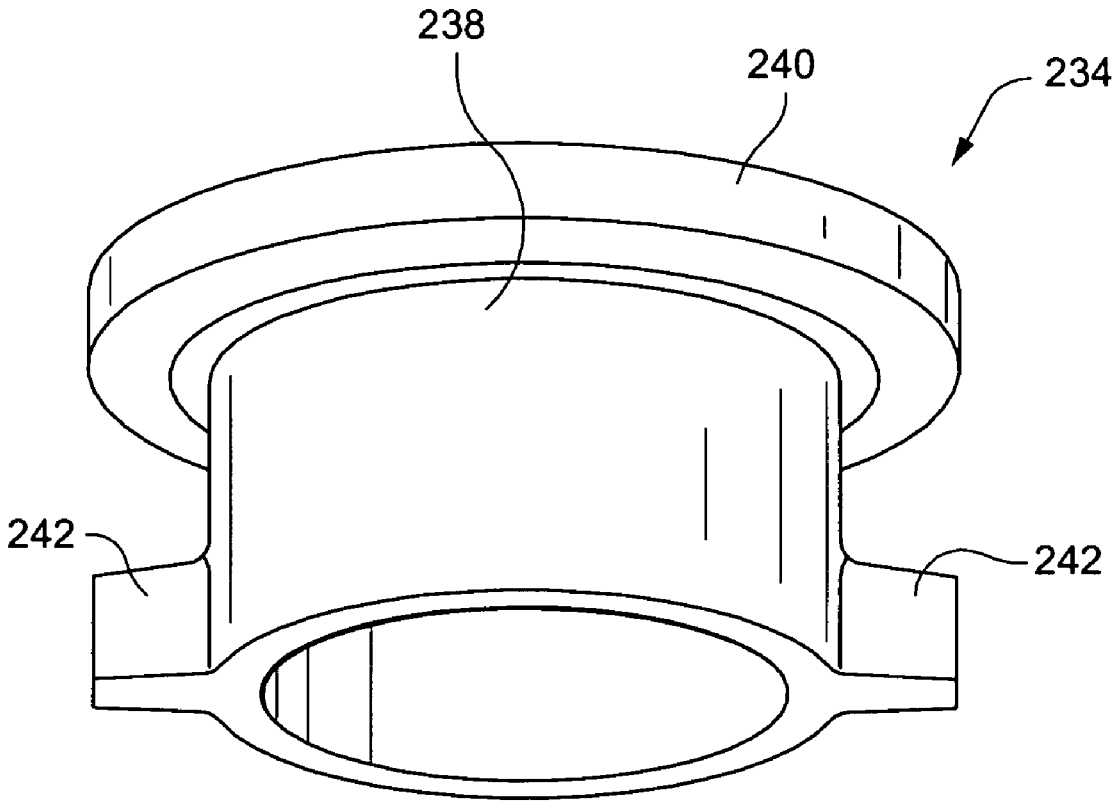
FIG. 23 is a perspective view of a sleeve component taken from the sprinkler shown in FIGS. 21 and 22.

FIGS. 21-23 illustrate a less-preferred spool configuration which differs from the embodiment shown in FIGS. 1-14 in a few respects. For the sake of brevity, only the differences will be discussed in detail. In this embodiment, a "half spool" 220 includes a cylindrical body 222 formed with an upper flange 224. A center disc 226 is located at the lower end of the body 222, and is formed with a center aperture 228 (FIG. 22). Support struts 230 extend from the half spool and carry the water-deflection plate 232. Thus, in this configuration, the lower portion of the spool body and the lower spool flange have been removed. A sleeve 234 is fixed on the starter tube 236, the sleeve 234 having a hub 238, an upper flange 240, and a pair of diametrically opposed starter lugs 242, best seen in FIG. 23 (alternatively, a single starter lug would perform adequately). The starter tube 236 is formed with a lower flange 244 as in the earlier-described embodiments, but an upper flange 246 has been added to locate the sleeve 234. Further in this regard, the cylindrical body of the tube 236 is now slotted to form individual spring fingers 248 which allow the sleeve 234 to be pushed onto the tube, snapping behind the lower flange 244.

In this arrangement, the disc 226 is located between the upper flange 240 and the starter lugs 242 with a small but sufficient clearance between the disc and the starter tube to permit wobbling motion as the water-deflection plate 232 and half spool 220 rotate. On the other hand, a generous clearance is provided between the cylindrical body 222 of the half spool 220 and the inside diameter of the race 250 so that the half spool stays centered through contact with the sleeve 234.

In a start-up mode shown in FIG. 21, the disc 226 and the starter lugs 242 are in contact such that the half spool 220 and water-deflection plate are tilted as previously described. There is also contact between the upper flange 224 and the upper surface of the race 250.

In the operational mode shown in FIG. 22, a slight clearance is maintained between the disc 226 and the starter lugs 242, while the upper flange 224 contacts and rolls about the upper surface of the race 250.

Figure 24:
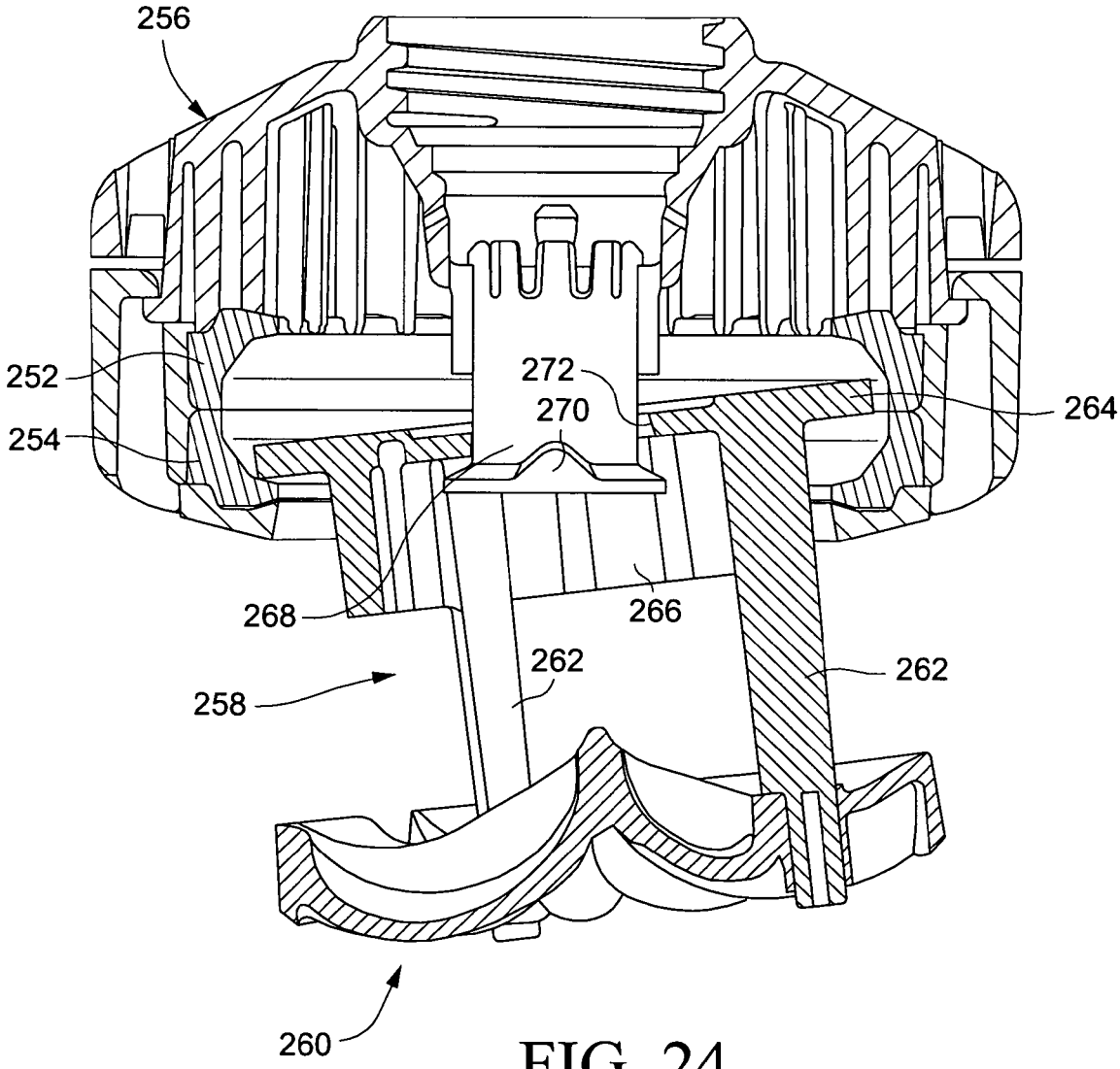
FIG. 24 is a cross section through a sprinkler head in accordance with still another embodiment of the invention, shown in a start-up mode.
Figure 25:
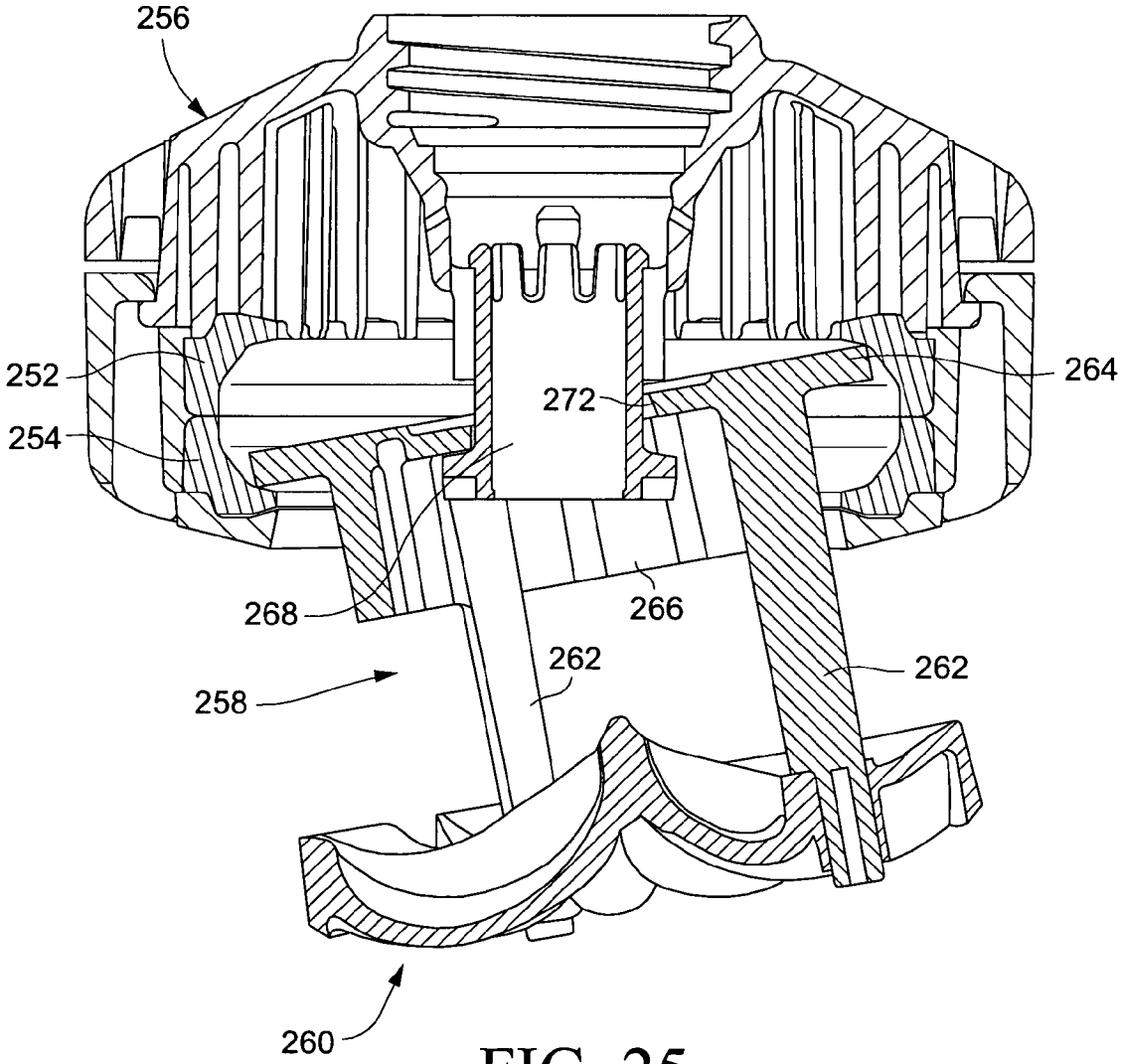
FIG. 25 is a cross section similar to FIG. 24, rotated 90° about a vertical axis in a counterclockwise direction, and in an operational mode.

FIGS. 24 and 25 show another exemplary but less preferred embodiment. Here again, only the significant differences between this embodiment and those previously described will be discussed in detail. In this embodiment, upper and lower races 252, 254 are arranged within the sprinkler housing 256. The races are substantially identical, and are arranged in back-to-back relationship. A cage assembly 258 includes the water-deflection plate 260, supported on struts 262 extending from the disc 264 at the upper end of a cylindrical skirt 266. The starter tube 268 is substantially identical to the starter tube 26 shown in FIG. 7, but the starter lugs 270 may be in diametrically opposed relationship.

Surfaces of the disc 264 that contact the races 252, 254, as well as surfaces of the races contacted by the disc 264 may be textured for good traction. The races 252, 254 may be made of an elastomeric material for good abrasion resistance, good traction and vibration dampening.

In the start-up mode shown in FIG. 24, the left side of disc 264 is engaged with the lower race, and the center region of the disc (surrounding the center aperture 272) engages the starter lugs 270, such that vertical down loads are resisted at these points. In addition, contact between the disc 264 and the starter tube 268 itself (in the same left center region) resists horizontal loads. Low friction surfaces allow easy sliding action between the disc 264 and the starter tube 268. In order to start wobbling rotation, the cage 258 must rotate up off the starter lugs 270, and as it does, horizontal loads are resisted by contact between the center aperture 272 and the outer diameter of the starter tube 268. Start up is facilitated by the fact that there is no contact between the disc 264 and either race 252, 254 on the opposite side of the disc, i.e., the right side, diametrically opposed to the contact point shown on the left hand side of the disc.

In the operational mode shown in FIG. 25, there is always a slight clearance between the disc 264 and the starter tube 268 (including the starter lugs 270) but continuous contact at diametrically opposed locations of the disc 264 with the races 252, 254. The contact between the disc 264 and the upper and lower races 252, 254 as shown in FIG. 25 is a rolling contact, providing good wear life. Note also that the contact area on the right side resists both horizontal and vertical up loads, while the contact area on the left resists vertical down loads.

It will be appreciated that the various features discussed in connection with the embodiment shown in FIGS. 1-15 (for example, the anti-drool feature) are equally applicable to the other embodiments described in connection with FIGS. 16-25 unless otherwise noted.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary, nutating sprinkler head comprising:

a housing supporting a nozzle including a starter tube extending in a downstream direction, concentric with a vertical center axis of the sprinkler head;

a spool assembly loosely supported on said starter tube, said spool assembly including a double-flanged spool and a water-deflection plate carried by said spool, said water-deflection plate formed with one or more grooves shaped to cause said spool assembly to rotate when impinged upon by a stream emitted from said starter tube;

wherein one of said starter tube and said spool is provided with at least one tilting lug located to maintain said spool assembly in a tilted or angularly offset orientation relative to said vertical center axis, thereby facilitating a wobbling action of said spool assembly during rotation.

2. The sprinkler head of claim 1 wherein said double-flanged spool comprises a cylindrical hub, an upper flange and a lower flange extending from said hub, a center disc within said hub, said center disc having a center opening therein through which said starter tube passes.

3. The sprinkler head of claim 2 wherein said housing carries an annular race having a radially inner surface and upper and lower surfaces engagable by portions of said upper and lower flanges, respectively, of said spool as said spool assembly rotates and wobbles about said center axis.

4. The sprinkler head of claim 3 wherein said housing comprises upper and lower housing components, said upper component formed with a radially inner wall incorporating a collar portion adapted for coupling to another component, wherein said nozzle is sandwiched between said another component and said upper housing component, and wherein said starter tube is carried by said radially inner wall.

5. The sprinkler head of claim 4 wherein said annular race is supported axially between said upper and lower housing components.

6. The sprinkler head of claim 5 wherein said annular race is formed with radially inner and outer surfaces connecting said upper and lower surfaces, said upper and lower surfaces formed with opposed, oppositely facing annular grooves adapted to be engaged by an annular intermediate wall of said upper housing component, and an inner annular rim of said lower housing component, respectively.

7. The sprinkler head of claim 6 wherein portions of said radially inner, upper, and lower surfaces of said race that are adapted to be engaged by said upper and lower flanges of said spool are textured.

8. The sprinkler head of claim 3 wherein said race is constructed of polyurethane.

9. The sprinkler head of claim 3 wherein said lower flange is formed with a shoulder engageable with said radially inner surface and said lower surface of said race.

10. The sprinkler head of claim 2 wherein said at least one tilting lug is provided on said starter tube.

11. The sprinkler head of claim 10 wherein said at least one starter lug comprises a pair of starter lugs circumferentially spaced from each other by about 90 degrees.

12. The sprinkler head of claim 1 wherein said water-deflection plate is supported from said spool by a plurality of struts.

13. The sprinkler head of claim 1 and further comprising a weight, said sprinkler head and said weight provided with complimentary means for enabling quick connect/disconnect of said weight to and from said sprinkler head.

14. The sprinkler head of claim 1 wherein surfaces of said housing are shaped to direct excess water on said housing into streams exiting the water-deflection plate.

15. A rotary, nutating sprinkler head comprising:

a housing supporting a nozzle tube extending in a downstream direction, concentric with a vertical center axis of the sprinkler head;

a spool assembly loosely supported on said nozzle tube, said spool assembly having upper and lower flanges including a water-deflection plate carried by said spool assembly, said water-deflection plate formed with one or more grooves shaped to cause said spool assembly to rotate when impinged upon by a stream emitted from said nozzle tube; and an annular race supported in said housing having upper and lower surfaces engageable by portions of said upper and lower flanges, respectively, of said spool assembly as said spool assembly rotates and wobbles about said center axis.

16. The sprinkler head of claim 15 wherein said annular race is formed with radially inner and outer surfaces connecting said upper and lower surfaces, said upper and lower surfaces formed with opposed, oppositely facing annular assembly grooves adapted to be engaged by an annular intermediate wall of an upper housing component, and an inner annular rim of a lower housing component, respectively.

17. The sprinkler head of claim 16 wherein portions of said radially inner, upper and lower surfaces of said race that are adapted to be engaged by said upper and lower flanges of said spool assembly are textured.

18. The sprinkler head of claim 17 wherein said race is constructed of polyurethane.

19. The sprinkler head of claim 16 wherein said assembly groove in said upper surface of said race is formed with a plurality of circumferentially-spaced ribs within said groove.

20. The sprinkler head of claim 16 wherein said lower flange is formed with a shoulder engageable with said radially inner surface and said lower surface of said race.

21. The sprinkler head of claim 15 and further comprising a weight, said sprinkler head and said weight provided with complimentary means for enabling quick connect/disconnect of said weight to and from said sprinkler head.

22. The sprinkler head of claim 15 wherein one of said nozzle tube and said spool assembly is provided with at least one tilting lug located to keep said spool assembly in a tilted or angularly offset orientation relative to said vertical center axis, thereby facilitating a wobbling action of said spool assembly during rotation.

23. A rotary, nutating sprinkler head comprising:

a housing supporting a nozzle tube extending in a downstream direction, concentric with a vertical center axis of the sprinkler head;

a spool assembly loosely supported on said tube, said spool assembly including a spool having a hub and upper and lower flanges, a water-deflection plate carried by said spool, said water-deflection plate formed with one or more grooves shaped to cause said spool assembly to rotate when impinged upon by a stream emitted from said nozzle tube;

an annular race supported in said housing having upper and lower surfaces engageable by portions of said upper and lower flanges, respectively, of said spool as said spool assembly rotates and wobbles about said center axis; and plural mating teeth formed on a radially inner surface of said race and on a lower portion of said hub for mated rolling action of said spool assembly about said race.

24. A rotary, nutating sprinkler head comprising:

a housing supporting a nozzle including a starter tube extending in a downstream direction, concentric with a vertical center axis of the sprinkler head;

a cage assembly loosely supported on said starter tube, said cage assembly including a disc and a water-deflection plate supported by plural struts extending downwardly from said disc, said water-deflection plate formed with one or more grooves shaped to cause said cage assembly to rotate when impinged upon by a stream emitted from said starter tube;

one or more tilting lugs located to maintain said cage assembly in a tilted or angularly offset orientation relative to said vertical center axis, thereby facilitating a wobbling action of said cage assembly during rotation; and a race supported in said housing and surrounding said cage assembly, said race adapted to be engaged in rolling contact by radial outward surfaces of said disc.

* * * * *